US009366109B2

(12) United States Patent
Themig et al.

(10) Patent No.: US 9,366,109 B2
(45) Date of Patent: Jun. 14, 2016

(54) KOBE SUB, WELLBORE TUBING STRING APPARATUS AND METHOD

(71) Applicant: PACKERS PLUS ENERGY SERVICES INC., Calgary (CA)

(72) Inventors: Daniel Jon Themig, Calgary (CA); Christopher Denis Desranleau, Sherwood Park (CA); Robert Joe Coon, Missouri City, TX (US)

(73) Assignee: PACKERS PLUS ENERGY SERVICES INC., Calgary (CA)

( * ) Notice: Subject to any disclaimer, the term of this patent is extended or adjusted under 35 U.S.C. 154(b) by 160 days.

(21) Appl. No.: 13/893,656

(22) Filed: May 14, 2013

(65) Prior Publication Data

US 2013/0312965 A1 Nov. 28, 2013

Related U.S. Application Data

(63) Continuation of application No. PCT/CA2011/001290, filed on Nov. 21, 2011.

(60) Provisional application No. 61/415,732, filed on Nov. 19, 2010, provisional application No. 61/417,260, filed on Nov. 25, 2010, provisional application No. 61/541,185, filed on Sep. 30, 2011.

(30) Foreign Application Priority Data

Dec. 30, 2010 (WO) ..... PCT/CA2010/002072

(51) Int. Cl.
*E21B 34/14* (2006.01)
*E21B 34/06* (2006.01)

(52) U.S. Cl.
CPC ..... *E21B 34/14* (2013.01); *E21B 34/063* (2013.01)

(58) Field of Classification Search
CPC ..... E21B 23/10; E21B 34/063; E21B 34/14; E21B 43/14
See application file for complete search history.

(56) References Cited

U.S. PATENT DOCUMENTS

| | | | | |
|---|---|---|---|---|
| 958,100 | A | 5/1910 | Decker | |
| 2,287,076 | A | 6/1942 | Zachry | |
| 2,903,074 | A | 9/1959 | Layton et al. | |
| 2,922,479 | A | 1/1960 | Kinley | |
| 3,051,143 | A | 8/1962 | Nee | |
| 3,095,040 | A | 6/1963 | Bramlett | |
| 3,661,207 | A * | 5/1972 | Current | E21B 33/1294 166/120 |
| 3,924,677 | A | 12/1975 | Prenner et al. | |

(Continued)

FOREIGN PATENT DOCUMENTS

| | | |
|---|---|---|
| CA | 2625662 A1 | 11/2008 |
| EP | 2360347 | 9/2006 |

(Continued)

*Primary Examiner* — William P Neuder
(74) *Attorney, Agent, or Firm* — Bennett Jones LLP

(57) ABSTRACT

To address concerns of kobe plug cap portions being inadvertently removed, for example, by abutment with strings or tools passing thereby, a shielding structure may be employed to protect the cap against inadvertent removal. The port opening tool useful with the kobe plug is selected to overcome the shielding structure to open the kobe plug. To address concerns of a portion of the kobe plug becoming loose in the tubing string inner bore, a capturing mechanism may be provided that captures the cap portion after it is removed to open the kobe plug and prevented the cap portion from becoming loose in the inner bore of the tubing string.

105 Claims, 11 Drawing Sheets

(56) References Cited

U.S. PATENT DOCUMENTS

| | | | |
|---|---|---|---|
| 4,068,712 | A | 1/1978 | Stump |
| 4,154,303 | A | 5/1979 | Fournier |
| 4,374,543 | A | 2/1983 | Richardson |
| 4,378,839 | A | 4/1983 | Fisher, Jr. |
| 4,566,541 | A | 1/1986 | Moussy et al. |
| 4,577,702 | A | 3/1986 | Faulkner |
| 4,601,343 | A | 7/1986 | Lindsey, Jr. et al. |
| 4,603,741 | A | 8/1986 | Edgmon |
| 4,693,314 | A | 9/1987 | Wesson et al. |
| 4,729,432 | A | 3/1988 | Helms |
| 4,846,272 | A | 7/1989 | Leggett |
| 4,893,678 | A | 1/1990 | Stokley et al. |
| 4,917,191 | A | 4/1990 | Hopmann et al. |
| 5,012,871 | A | 5/1991 | Pleasants et al. |
| 5,413,180 | A | 5/1995 | Ross et al. |
| 5,526,881 | A | 6/1996 | Martin et al. |
| 5,803,173 | A | 9/1998 | Fraser, III et al. |
| 6,003,607 | A | 12/1999 | Hagen et al. |
| 6,006,838 | A | 12/1999 | Whiteley et al. |
| 6,220,316 | B1 | 4/2001 | Lin |
| 6,220,356 | B1 | 4/2001 | Spikes |
| 6,382,324 | B1 | 5/2002 | Anyan |
| 6,397,950 | B1 | 6/2002 | Streich et al. |
| 6,763,892 | B2 | 7/2004 | Kaszuba |
| 6,920,930 | B2 | 7/2005 | Allamon et al. |
| 6,945,331 | B2 | 9/2005 | Patel |
| 6,997,263 | B2 | 2/2006 | Campbell et al. |
| 7,051,812 | B2 | 5/2006 | McKee et al. |
| 7,287,596 | B2 | 10/2007 | Frazier et al. |
| 7,387,165 | B2 | 6/2008 | Lopez de Cardenas et al. |
| 7,431,091 | B2 | 10/2008 | Themig et al. |
| 7,533,727 | B2 | 5/2009 | Barton et al. |
| 7,543,634 | B2 | 6/2009 | Fehr et al. |
| 7,673,677 | B2 | 3/2010 | King et al. |
| 7,703,510 | B2 | 4/2010 | Xu |
| 7,708,066 | B2 | 5/2010 | Frazier |
| 7,730,949 | B2 | 6/2010 | Guignard et al. |
| 7,748,460 | B2 | 7/2010 | Themig et al. |
| 2003/0127227 | A1 | 7/2003 | Fehr et al. |
| 2004/0035586 | A1 | 2/2004 | Gudmestad et al. |
| 2006/0124310 | A1 | 6/2006 | Lopez et al. |
| 2006/0207764 | A1 | 9/2006 | Rytlewski |
| 2007/0221373 | A1 | 9/2007 | Murray |
| 2007/0272411 | A1 | 11/2007 | Lopez De Cardenas et al. |
| 2008/0156498 | A1* | 7/2008 | Phi et al. ..... 166/376 |
| 2008/0289813 | A1 | 11/2008 | Gewily et al. |
| 2009/0044944 | A1 | 2/2009 | Murray et al. |
| 2009/0065194 | A1 | 3/2009 | Frazier |
| 2009/0084553 | A1 | 4/2009 | Rytlewski et al. |
| 2009/0139717 | A1 | 6/2009 | Richard et al. |
| 2009/0159279 | A1 | 6/2009 | Assal |
| 2010/0000727 | A1 | 1/2010 | Webb et al. |
| 2010/0038096 | A1 | 2/2010 | Reimert et al. |
| 2010/0263873 | A1 | 10/2010 | Turner et al. |
| 2010/0282469 | A1 | 11/2010 | Richard et al. |
| 2011/0030968 | A1 | 2/2011 | Xu |
| 2011/0030976 | A1 | 2/2011 | King |
| 2011/0088908 | A1 | 4/2011 | Xu |
| 2011/0192613 | A1 | 8/2011 | Garcia et al. |
| 2013/0168090 | A1* | 7/2013 | Themig et al. ..... 166/285 |
| 2014/0151052 | A1* | 6/2014 | Themig et al. ..... 166/308.1 |

FOREIGN PATENT DOCUMENTS

| | | |
|---|---|---|
| GB | 2258478 | 2/1993 |
| WO | WO 2008/119931 | 10/2008 |
| WO | WO 2009/029437 A1 | 3/2009 |
| WO | WO 2009/132462 | 5/2009 |
| WO | WO 2010/025150 A2 | 3/2010 |
| WO | WO 2011/079391 | 7/2011 |
| WO | WO 2011/079391 A1 | 7/2011 |
| WO | WO2011079391 | 7/2011 |
| WO | WO 2011/097632 A1 | 8/2011 |
| WO | WO 2011/100748 | 8/2011 |

* cited by examiner

KOBE SUB, WELLBORE TUBING STRING APPARATUS AND METHOD

FIELD

The invention is directed to a wellbore apparatus and method and, in particular a kobe sub, wellbore tubing string and method.

BACKGROUND

In wellbore operations, tubing strings are used having walls with one or more ports extending therethrough. The ports permit fluid access from the tubing string inner diameter and the tubing string's outer surface, which is open to the wellbore.

A kobe plug, also called a break-off plug or a kobe, is closure that can be mounted at its base over a port with a cap portion extending from the base. A channel extends through the base into the cap, but is closed off at the cap. The cap portion protrudes from the port and is removable from the base to open the port to fluid flow through the channel. A kobe plug is installed in a tubular housing, called a kobe sub, that can be installed into a wellbore tubing string. The cap portion of the kobe plug often protrudes into the inner bore of the tubing string.

Generally, the kobe plug is removed by running a tool through inner bore of the string to break off the cap portion. The tool may be a drop bar, a cutter tool, etc. In some embodiments, there they may be concern of a cap being inadvertently removed by abutment by a treatment string or a tool, as it is passed thereby.

In some other embodiments, the cap portion, when removed from its port, is loose and can interfere with string operations. Such loose portions of the cap can, for example, jam in tools or in string structures or can obstruct ports.

SUMMARY

In accordance with a broad aspect of the present invention, there is provided a kobe sub comprising: a tubular body connectable into a wellbore tubing string, the tubular body including a wall including an outer surface and an inner surface defining an inner bore and a port through the wall; a kobe plug installed in the port with a cap portion accessible in the inner bore, a base mounted in the port and connected to the cap portion, a channel extending through the base and closed by the cap portion; and a shielding structure in the inner bore to shield the cap portion from protruding into the inner bore.

In accordance with another broad aspect of the present invention, there is a provided a method for forming a fluid channel through a tubing string wall, the method comprising: installing a tubing string in a wellbore, the tubing string including a tubular wall including an outer surface and an inner surface defining an open inner bore and a port through the wall; a kobe plug installed in the port with a cap portion accessible in the inner bore, a base mounted in the port and connected to the cap portion, a channel extending through the base and closed by the cap portion; and a shielding structure in the inner bore to shield the cap portion from protruding into the inner bore; introducing a port opening tool into the inner bore; manipulating the tool to overcome the shielding structure; and removing the cap portion to open the channel and form the fluid channel though the tubing string wall.

In accordance with another broad aspect of the present invention, there is a provided a tubing string system for installation in a wellbore comprising: a tubular body including a tubular wall with an outer surface and an inner surface defining an inner bore and a port through the tubular wall; a kobe plug installed in the port with a cap portion accessible in the inner bore, a base mounted in the port and connected to the cap portion, a channel extending through the base and closed by the cap portion; a shielding structure in the inner bore to shield the cap portion from protruding into the inner bore; and a port opening tool for overcoming the shielding structure and removing the cap portion from the base.

In accordance with a broad aspect of the present invention, there is provided a kobe sub comprising: a tubular body connectable into a wellbore tubing string, the tubular body including a wall including an outer surface and an inner surface defining an inner bore and a port through the wall; a kobe plug installed in the port including a base mounted in the port, a cap portion accessible in the inner bore and connected to the base and a channel extending through the base and closed by the cap portion, the cap portion being removable from the base to open the channel to allow fluid passage though the channel from the inner bore to the outer surface; and a capturing mechanism to capture the cap portion from becoming loose in the inner bore after the cap portion is removed from a sealing position on the base.

In accordance with another broad aspect of the present invention, there is a provided a method for forming a fluid channel through a tubing string wall, the method comprising: installing a tubing string in a wellbore, the tubing string including a tubular wall including an outer surface and an inner surface defining an open inner bore and a port through the wall; and a kobe plug installed in the port including a base mounted in the port, a cap portion accessible in the inner bore and connected to the base and a channel extending through the base and closed by the cap portion, the cap portion being removable from the base to open the channel to allow fluid passage though the channel from the inner bore to the outer surface; introducing a port opening tool into the inner bore; manipulating the tool to remove the cap portion from a sealing position on the base to open the channel; and capturing the cap portion to prevent the cap portion from becoming loose in the inner bore.

In accordance with another broad aspect of the present invention, there is a provided a tubing string system for installation in a wellbore comprising: a tubular body including a tubular wall with an outer surface and an inner surface defining an open inner bore and a port through the wall; a kobe plug installed in the port including a base mounted in the port, a cap portion accessible in the inner bore and connected to the base and a channel extending through the base and closed by the cap portion, the cap portion being removable from the base to open the channel to allow fluid passage though the channel from the inner bore to the outer surface; a port opening tool for removing the cap portion from a sealing position on the base; and a capturing mechanism to capture the cap portion from becoming loose in the inner bore after the cap portion is removed from the sealing position on the base.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings:

FIG. 2A is a first sectional view through the port and FIGS. 2B to 2G are sequential views along line I-I of FIG. 2A.

FIG. 4A is a first sectional view through the port and FIG. 4B is a section along line II-II of FIG. 4A.

DESCRIPTION OF VARIOUS EMBODIMENTS

Figure 1A:
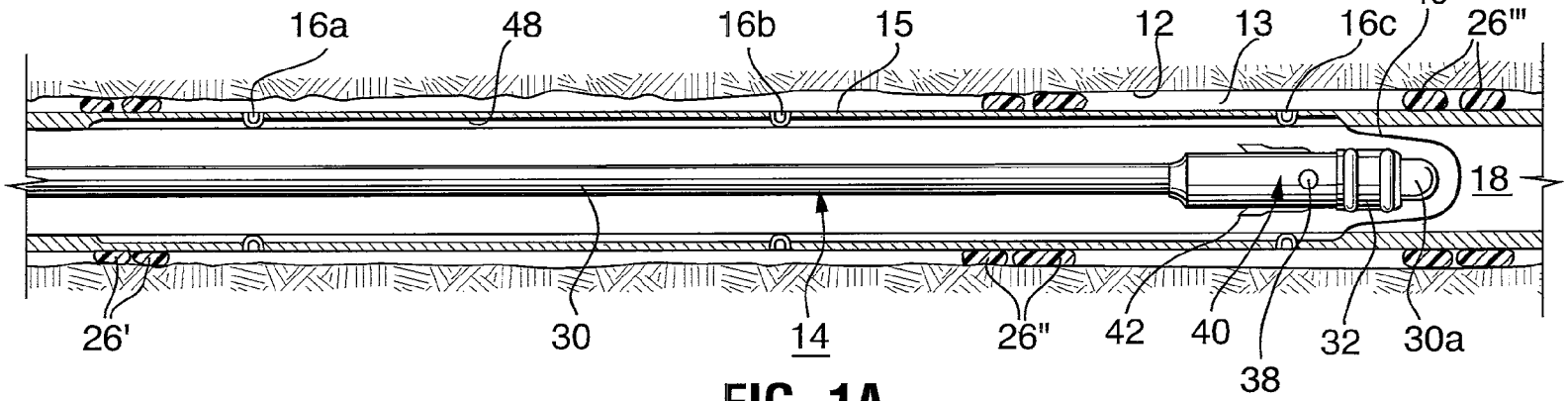
FIGS. 1A, 1B and 1D are sequential schematic sectional views through a wellbore with a liner installed therein with port closures being opened to effect a wellbore treatment.
Figure 1B:
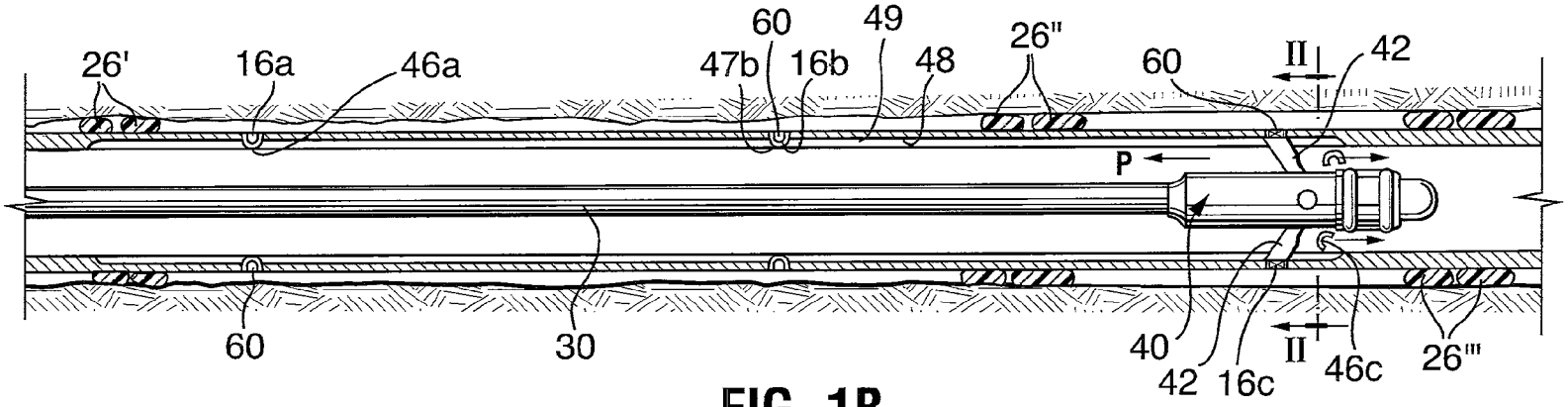
Figure 1C:
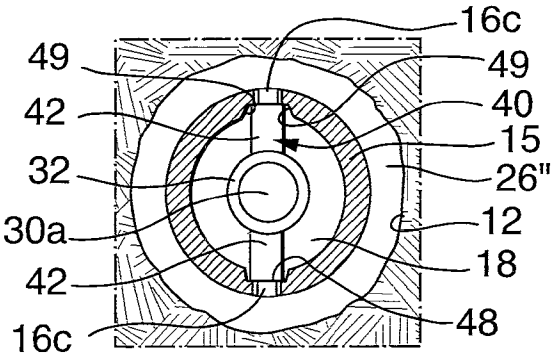
FIG. 1C is a sectional view though the installation along line II-II of FIG. 1B.

The description that follows and the embodiments described therein are provided by way of illustration of an example, or examples, of particular embodiments of the principles of various aspects of the present invention. These examples are provided for the purposes of explanation, and not of limitation, of those principles and of the invention in its various aspects. In the description, similar parts are marked throughout the specification and the drawings with the same respective reference numerals. The drawings are not necessarily to scale and in some instances proportions may have been exaggerated in order more clearly to depict certain features FIGS. 1A and 1B illustrate a possible wellbore assembly and method that employ kobe plugs 46 as port closures in a tubing string 10.

In wellbore operations, for example, tubing string 10 may be installed in a wellbore 12. The tubing string may have a tubular form and include an upper end 15*a*, a lower end 15*b* and at least one fluid outlet port 16*a* extending through the tubing string wall to provide fluid communication between the tubing string's inner bore 18 and the tubing string's outer surface 20, which is open to an annulus in communication with the wellbore wall.

In some embodiments, there may be a plurality of fluid outlet ports along the tubing string, which may include, for example, outlet port 16*a*, a second fluid outlet port 16*b* axially spaced (i.e. downhole or uphole from) the first fluid outlet port and possibly further fluid outlet ports 16*c*.

The ports may be closed to control inner bore fluid conditions and may be selectively openable, when desired, to permit fluid access between the inner bore and the outer surface. In one embodiment, for example, the ports are each closed by kobe plugs 46*a*, 46*b*, 46*c* (collectively referenced as kobe plugs 46).

A kobe plug is a cap including a cap portion, a base attached to the cap portion, and a channel that extends through the base and into the cap portion. The kobe plug can be mounted at its base in a port with the cap portion protruding beyond the surrounding wall surface. The base can be sealed to the port walls, such that the channel creates the flow path through the port. Cap portion, however, while in place on the base seals the channel against fluid flow. Cap portion, therefore, must be removed to open the port. The cap cap portion can be removed by shearing, breaking off, breaking open, pushing through the wall, etc. Sometimes the kobe plug includes a weakened area between the base and cap portion that facilitates separation of the cap portion from the base. A kobe plug may be installed in a tubular body with the cap portion protruding above the surrounding material of the tubular body. Generally, the kobe plug cap portion is accessible in the inner bore of the tubular body. The tubular body may be connected into a wellbore string. The tubular body with the kobe plug is known as a kobe sub.

A port-opening tool 40, which may take various forms, may be selected to pass through the tubing string inner diameter (FIG. 1A) and remove the cap of one or more the plugs 46 to open the ports (FIG. 1B). The tool may be formed to directly remove (i.e. cut off or abut against, etc.) the cap portions of the plugs 46, as shown, to open fluid access to the channel through the port protected by the cap. Alternately, a port-opening tool may be formed to drive another structure to cut off or abut against, etc. the cap portions. Tool 40 may be connected to a work string, as shown, or may be free from any connections to surface. In the illustrated embodiment, a treatment assembly 14 includes a port-opening tool 40 carried on a work string 30. Tool 40 includes a pair of diametrically opposed fingers 42 with cutters formed at the outboard tips thereof. Tool 40 can be actuated between an inactive position, where fingers 42 are collapsed and an active position, where fingers 42, are expanded.

In some embodiments, there they may be concern of a kobe plug cap portion being inadvertently removed, for example, by abutment with a treatment string or a tool head, as it is passed thereby. In such an embodiment, a shielding structure may be employed to protect the cap against inadvertent removal and the port opening tool is selected to overcome the shielding structure to open the kobe plug. The shielding structure may include a shielding wall such as may be provided an extension of the tubing string wall or by a recess in which the kobe cap portion may be recessed. In such systems, the cap portion is recessed behind the wall to protect it from abutment of tools and strings passing thereby and the port opening tool is selected to overcome the shielding of the wall by reaching past the wall to access the kobe plug cap.

FIG. 1 illustrate an assembly and a method employing a kobe plug that is protected by a shielding structure formed as a shielding wall positioned alongside the kobe plug. The shielding wall may, for example, be the wall leading to a recess in the wall of the tubing string or a wall extending out from the tubing string inner wall. In FIG. 1, while kobe plugs 46*a*, 46*b*, 46*c* are opened by shearing the cap portions from the bases, the kobe plugs are protected from inadvertent opening by placement in a slot 48 along the liner inner wall. The slot may be formed as an elongate recess in the wall of the liner and may be exposed in the inner bore 18. The width of the slot is defined by slot walls 49 that extend from the liner inner wall surface to the bottom of the slot. Ports 16 with kobe plugs 46 thereover may be positioned in the depth of the slot such that the slot walls protect the kobe plugs from being engaged by structures, such as assembly 14, moving therepast in the liner inner bore. The depth of the slot and the height of the cap portions of kobe plugs may be correspondingly sized such that the cap portions substantially do not protrude into the main drift diameter of inner bore 18. In other words, the height of the cap portion may be selected to be less than the depth of the slot such that the cap portion does not protrude inwardly beyond the surfaces of the tubing's inner wall surfaces into which the slot extends.

To further protect the cap portions from accidental opening by inadvertent contact with tools passing thereby, the width of the slot may be selected such that fingers 42 of tool 14 can enter the slot, but other parts of tool 40 and string 30 cannot. As noted, port-opening tool 40 includes fingers 42 with cutters formed at the outboard tips thereof. The fingers and cutters are sized to penetrate between the slot walls and ride along slot 48 removing the cap portions from the ports by shearing them off (see for example cap 46*c*, FIG. 1B).

In this illustrated embodiment, two slots are shown each with a plurality of ports positioned therein. The slots extend along the liner wall between the ports in at least a series of ports 16*a*, 16*b*, 16*c*, such that when the fingers are expanded and each located in a slot, the tool can be moved, arrow P, along the liner with the fingers remaining in their slots to open a plurality of closures without needing to relocate the tool fingers for each port. Of course, the slot may span fewer ports than those to be opened in one stage of the operation. For example, the slot may accommodate only one port. This may require that each finger run through a number of slots during one stage of the opening operation for a series of ports.

To facilitate the location of a finger 42 in a slot 48, a mule shoe recess 49 may be employed. The mule shoe recess is a groove formed in the tubing string inner wall. The mule shoe recess has edges that due to the diameter change from the drift diameter to the larger, groove diameter form shoulders. The shoulder at one end of the groove extends to form a tapering extension extended along the long axis of the tubing string. As such, the groove has generally a tear drop shape, with an end tapering from a larger width to a narrower width. The groove, therefore, can act as a funnel-like guide for tool positioning. A key on tool 40 may be landed in the mule shoe recess and may be guided to the correct rotational orientation as guided into the tapering extension, by moving the key along the shoulder, to locate fingers 42 in their slots. Alternately, the mule shoe recess 49 may be positioned with the tapering extension leading directly into slots 48 such that a finger may be correctly positioned in a slot by being moved to follow the groove's shoulder.

In FIG. 1, a series of ports in the liner string are all opened before a wellbore treatment is undertaken. Any number of ports can be opened, such as one to four or more, and then a wellbore fluid treatment operation, such as a fracing operation is initiated. Because the kobe plug closures for the ports are recessed and, therefore, shielded from accidental opening, there is little risk of ports other than those intended being opened. The wellbore fluid treatment operation can be initiated down the annular area or through the tubing string to simultaneously treat the wellbore using the ports in the series. The ports may be opened to one or more intervals in the well. The system may use a limited entry type technique to ensure the frac fluid is appropriately distributed between the opened ports. In a limited entry system, a sized nozzle is installed in at least some of the ports in the series to allow distribution of the fluid in an appropriate and planned manner through all the ports in the series that are to be opened and fraced together.

To facilitate understanding of how the string may be employed a description of one possible method follows. The method includes running into the well with liner 15 including at least one series of selectively openable ports 16*a*, 16*b*, 16*c*. The liner can be set in the well to create an annulus 13 between the wellbore wall 12 and the liner. If desired, without cementing the annulus, isolated intervals can be established along the well by setting liner-conveyed packers 26', 26", 26''' to create annular seals in the annulus. The space between each adjacent pair of packers represents an isolated interval and the ports are each positioned to provide communication from the liner inner bore 18 to an isolated interval. Some isolated intervals, such as that between seal 26' and seal 26", can be accessed by more than one axially spaced port. The series of ports can be in the same interval, with a packer on either side of the series, but not separating annular communication between the ports of the series, or, as shown, packers can be installed to separate one or more of the ports in the series from one or more other ports in the series.

In this illustrated embodiment, ports 16*a*, 16*b*, 16*c* when run in are each closed by kobe plug closures 46*a*, 46*b*, 46*c*, but can be selectively opened, as described above, by operation of port-opening tool 40 carried on treatment string assembly 14 that can be moved through the liner inner bore. In this embodiment, tubing string 30 has an inner conduit in fluid communication with surface and a closed bottom end 30*a* and assembly 14 also carries a seal, such as a settable/releasable packer 32, carried on the string and actuable to create a seal between the tubing string and liner 15, a port 38 providing fluid communication, when opened, between the outer surface of the tubing string and the inner conduit above the seal (on a side of the seal opposite bottom end 30*a*). Of course, this being only an example of the wellbore assembly using a kobe plug, the treatment string components can be selected according to various options.

When it is time to begin a wellbore fluid treatment, such as a fracing operation, the treatment string can be moved or introduced open and treat though the ports along the string. Generally, the ports at the distal end of the well are employed first and the fracing operation is conducted moving up through the well.

Figure 1D:
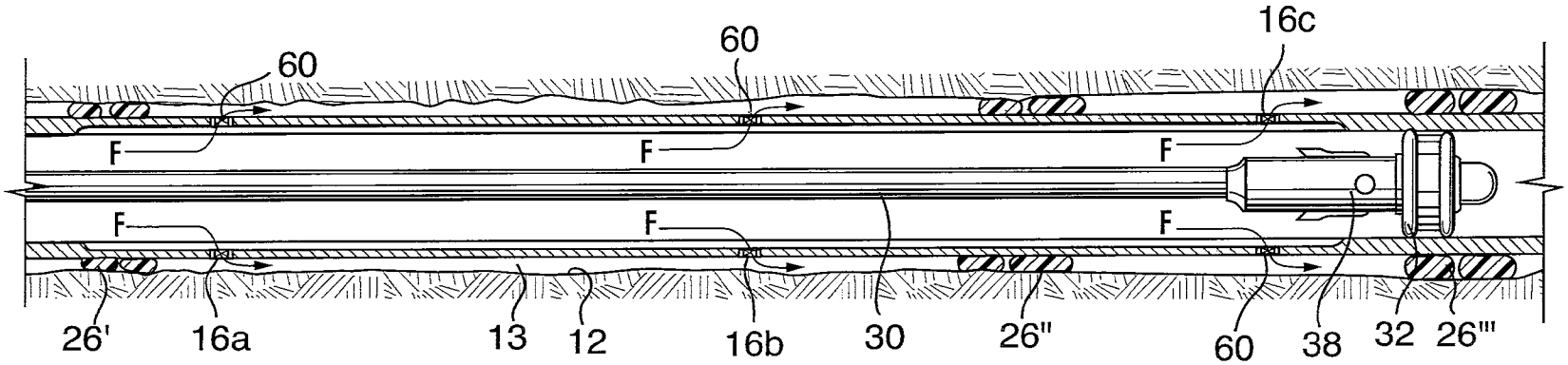

Eventually preparations are carried out for fluid treatment through series of ports 16*a*, 16*b*, 16*c*. First, the series of ports are opened (FIGS. 1B and 1C) to provide for fluid communication between inner bore 18 and annulus 13. To do this, the port-opening tool 40 can be moved to the ports to open their closures 46. For example, port-opening tool 40 can be moved, arrow P, from port to port in the series of ports and can actuate the ports to open. In one embodiment, as the shifting tool is moved through the liner inner bore, the port-opening tool, if not already in position, can be activated into an active position to expand fingers 42. Activation of tool 40 can be by pressure, by flow, by shearing or by directional movement up or down. Fingers 42 are then located in slots 48 (FIGS. 1B and 1C) and the cap portions of kobe plugs 46 are removed by pulling, arrow P, fingers 42 through the slots 48 to shear off the caps. After the series of ports 16*a*, 16*b*, 16*c* are open, the string 30 is moved downhole below the lowermost of the ports in the series, in this case port 16*c*, and the seal member 32 is then set to seal off the annular area 36 between the liner and the string to isolate all the zones below from the series of opened ports (FIG. 1D).

Once all the selected ports are opened and the liner below the opened ports is sealed, then fluid can be introduced, arrows F, to treat the wellbore through the opened ports. For example, as shown, one or more wellbore intervals can be fraced simultaneously through the opened series of ports. Ports 16*a*, 16*b*, 16*c* in the series can include valves 60 therein to provide for limited entry and, thereby, appropriate distribution of fluids through the ports in the series. Wellbore treatment fluids can be introduced from surface through the annular area 36, as shown, and/or through the tubing string inner bore, exiting through port 38. In the illustrated embodiment, wellbore fracing fluids are introduced from surface through the annular area 36 and port 38 is open to monitor downhole pressure conditions. String 30 remains pressurized to ensure fluids do not circulate upwardly therethrough. Fracing fluids F exit through ports 16*a*, 16*b*, 16*c* into the annulus 13 and into contact with the open hole wellbore wall along the intervals between packers 26' and 26" and between packers 26" and 26'''.

The foregoing process can be repeated at a plurality of series of ports moving up through the liner. For example, after fluid treatment, the packer 32 can be unset and the treatment string assembly may be moved upwardly in the liner to a next series of one or more ports, the port-opening tool can be manipulated to shear off the caps in that next series, the treatment string assembly can be moved below the lowermost of the opened ports in that next series where the sealing member can be set to seal the annular area and a fluid treatment can be conducted through the opened ports.

The process and system therefore allows an operator to access and treat multiple intervals at the same time and, so, provides significant savings in terms of time and cost, without a significant risk of kobes being inadvertently removed by assembly 14, including inactive tool 40 or string 30.

While FIG. 1 illustrate a wellbore assembly with kobe plugs that are shielded against inadvertent opening, in addition or alternately, there they may be a concern of a portion of the kobe plug being loose in the tubing string inner bore since that portion, for example cap portion 46*c*', may interfere with (i.e. jam, obstruct, etc.) tubing string operations. As such, in an embodiment, the kobe plug may be configured with a capturing mechanism such that a part of the kobe plug, such as the cap portion or a portion thereof, that is removed to open a port remains captured and is prevented from becoming loose in the liner inner bore.

In one embodiment, the part that is removed to open the kobe plug may be captured by being forced outwardly away from the inner bore toward the outer surface of the string.

Alternately or in addition, the part that is removed to open the kobe plug may be captured by being stored after it is removed. The part may be stored by the port-opening tool, by remaining attached to the remainder of the kobe plug, by storage in the tubing string, etc. Storage options may include hinge connections, snap-type retainers, frictional retaining mechanisms, magnetic attraction, etc.

Examples of captured kobe plugs follow, including some that also are shielded against inadvertent opening.

For example, a captured and shielded kobe plug is shown in FIGS. 2A to 2G. In this embodiment, a port 116 in a tubing string wall 115 has a closure in the form of a kobe plug 146 including a cap portion 146*a* and a base 146*b*. The kobe plug includes a channel 146*c* through the base that extends up into, but is sealed off by, cap portion 146*a*. Kobe plug 146 is installed in port 116 with seals 146*d* between the port walls and base 146*b*. Channel 146*c* actually forms the flow path area of the port, but is normally closed by the cap portion, which overlies and seals access to the channel.

In this embodiment, kobe plug 146 is shielded against inadvertent opening. In particular, a slot 148, defined between slot walls 149, may be formed in the tubing string wall 115 exposed in the tubing string's inner bore. The width of the slot, which is the distance between the slot walls 149, can be selected with consideration as to the size of the treatment string components such that only selected components can pass into the valley. For example, the slot width (from wall 149 to wall 149) can be less than the diameter of the tubing string such that the slot is sized to prevent a coiled tubing string, such as string 30 of assembly 14 in FIG. 1A, from entering the valley. Port 116 and kobe plug 146 may be positioned in the depth of the slot such that the slot walls protect the cap from being engaged by structures moving therepast in the tubing string inner bore. In such an embodiment, a finger 142 can be carried on the port-opening tool that can reach into the slot and open the port by opening cap portion 146*a* to expose channel 146*c*. The illustrated kobe plug is opened by removing a portion of the cap portion. While that portion could be removed completely from the port and released into the liner, in this embodiment it is desirable to limit the release of debris into the tubing string as such debris can interfere with tubing operations. As such, the portion removed to open the kobe plug is captured.

Figure 2A:
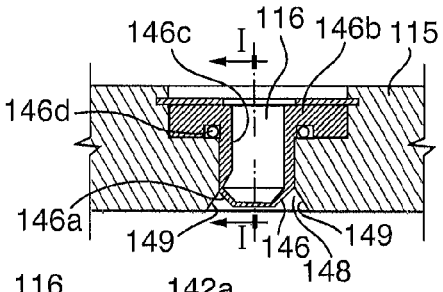
FIGS. 2A to 2G are sequential schematic sectional drawings through a port showing the opening of a port closure using a treatment string.
Figure 2B:
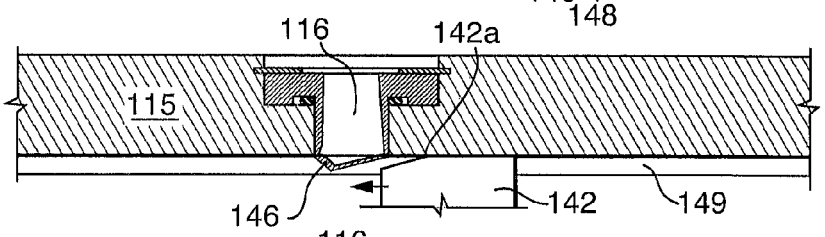
Figure 2C:
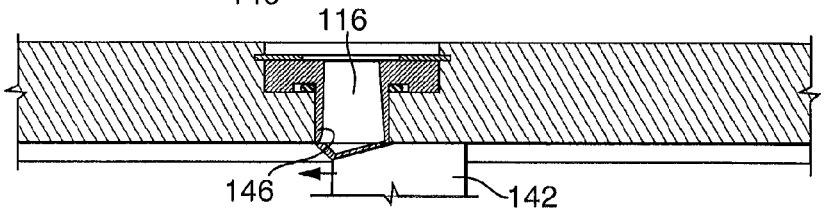
Figure 2D:
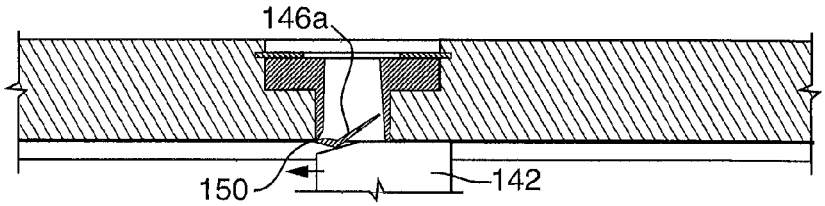
Figure 2E:
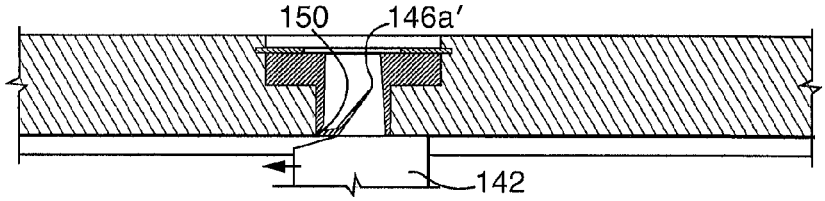
Figure 2F:
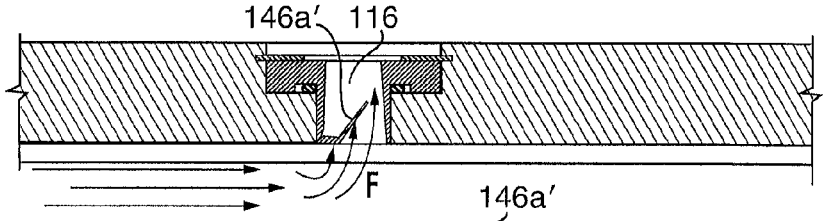
Figure 2G:
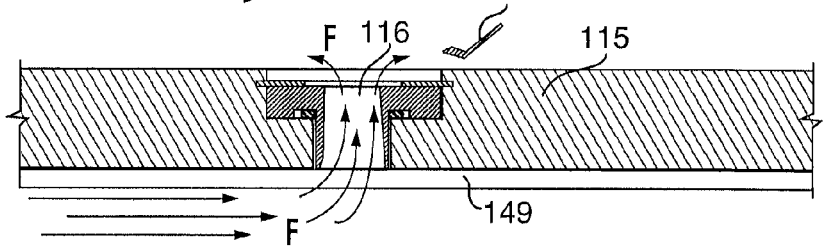

For example, as shown, finger 142 operates to open the kobe plug by breaking cap portion 146*a* open and pushing the cap portion out into the port. In particular, finger 142 can be inserted into the slot between walls 149 (FIG. 2B) and moved, as by pulling or pushing, past cap 146. In so doing, finger 142, as it passes, can bear against and break open the cap to create a flap 146*a*' that is pushed out into the port (FIGS. 2C to 2E). After acting on the cap portion, finger 142 may moved to allow fluid access to port 116. For example, as shown in FIG. 2F, the finger may be moved with the tool to another position in the well or removed from the well. The flap 146*a*' may be removed completely from its position over the port or, as shown in FIG. 2E, may remain stored, as by being connect at a hinge 150 to the remainder of the kobe plug. However, regardless, the integrity of the cap is compromised such that channel 146*c* is opened therethrough and fluid, such as fracing fluid F, may be pumped out through the opened cap and its associated port 116. As the fluid passes out through the port, the flap may be pushed out of the way and may break free at hinge 150 such that the flap is removed altogether (FIG. 2G). However, the force of the fluid pushes the flap through port 116 such that it is expelled from the tubing string.

Thus, in the embodiment of FIG. 2, the portion of the kobe plug that is removed is captured. Initially, it is captured by remaining connected at hinge 150 and thereafter it is captured in the annulus away from the tubing string inner bore. In both conditions, the removed part 146*a*' of the cap portion cannot interfere with the operations in the inner bore of the tubing string.

Finger 142 may be sized to fit into slot 148 and move therealong to act on kobe plug 146. Finger 142 may have a radiused or chamfered leading end 142*a* such that it tends not to get caught up on discontinuities in the tubing string or slot. Alternately or in addition, cap 146 can be formed to present a ramped surface such that finger 142 tends to move over the cap rather than being caught up on it. Also, this forming of the finger and/or the cap tends to urge the cap outwardly through the port rather causing the cap to move into the inner diameter of the tubing string. For example, this forming causes leading end 142*a* of the finger to ride up onto the cap portion, which tends to push the opened flap 146*a*' out through channel 146*c*.

Finger 142 may always protrude in an active position from the port-opening tool or may be moveable from a retracted position to an active position. In one embodiment, for example, the tool may include a finger and a shifting tool to move the finger between a retracted position and an exposed, active position. The shifting tool may, for example, be a 360° collet shifting tool that activates the finger. The finger can be moved into an active position by the shifting tool, moved into the valley and moved across the cap to remove the cap.

Figure 3A:
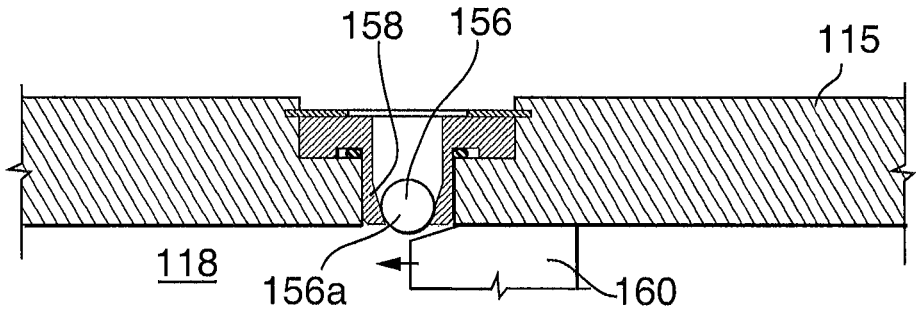
FIGS. 3A to 3C are sequential schematic sectional drawings along a port showing the opening of a port closure using a treatment string.
Figure 3B:
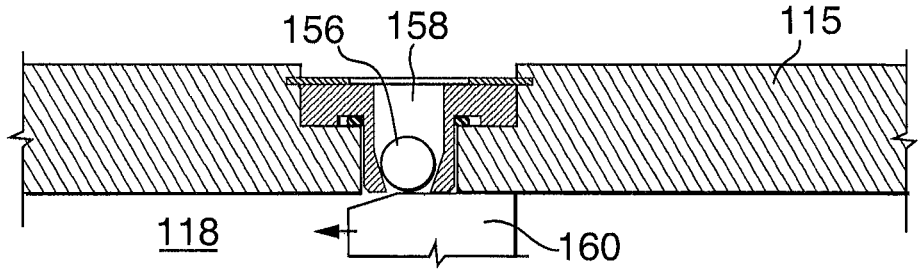
Figure 3C:
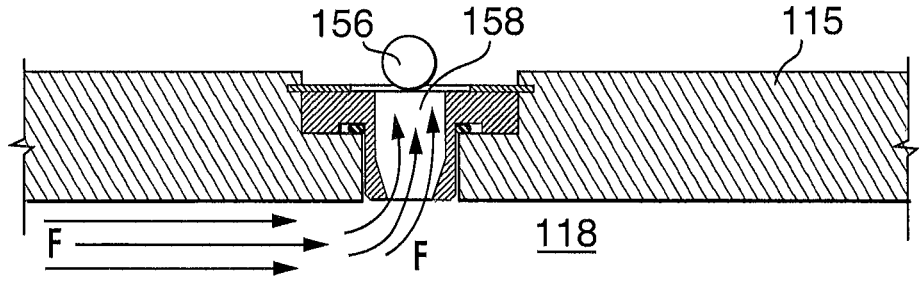

Another kobe plug that operates to direct the opened cap portion away from inner bore is shown in FIG. 3. In this embodiment, a kobe plug closure includes a plug installed in a channel that may be moved out of a sealing position to open the port. For example, a ball-bearing plug 156 may be installed, as by press fitting, in a narrowed portion of a tapered port 158. Port 158 may be formed, as shown, by an insert sealed in a hole through the tubing string wall 115 or by forming the hole itself. The plug is installed to have a contact portion 156*a* protruding at least a distance into the ID of the tubing string such that a tool passing through the tubing string inner bore 118 may contact the plug. The installation of plug 156 in port 158 can be selected to hold the internal pressures intended to be used in the tubing string. However, plug 156 can be removed from port 158, to open the port, by applying a mechanical force, greater than that force exerted by any operational fluid pressure, against contact portion 156*a* to push it out. Port 158 tapers inwardly from the tubing string outer surface to the inner bore such that the plug can more easily pass outwardly from the port once it is freed from its installed position. In such an embodiment, the port-opening tool can include a structure such as an anvil 160 that can be moved over the plug to apply a pressure against its exposed portion 156*a* to drive the plug radially outwardly. The pressure frees the plug from its installed position in port 158. After the anvil passes, even if the plug is not fully removed from the port it is loosened and fluid pressure, for example fracing fluid F, can fully eject the plug from the port (FIG. 3C). The embodiment, of FIG. 3 is included to illustrate another embodiment of a kobe sub having an opened part that is captured by directing it outwardly toward outer surface 115*a* away from inner bore 118 of the tubing string. Of course, while not illustrated, plug 156 and port 158 may be installed in a recessed area to protect the plug from inadvertent strikes by tools passing thereby. However, the low profile presented by the plug's contact portion 156*a* may not readily be affected by occasional abutment of tools passing thereby.

Figure 4A:
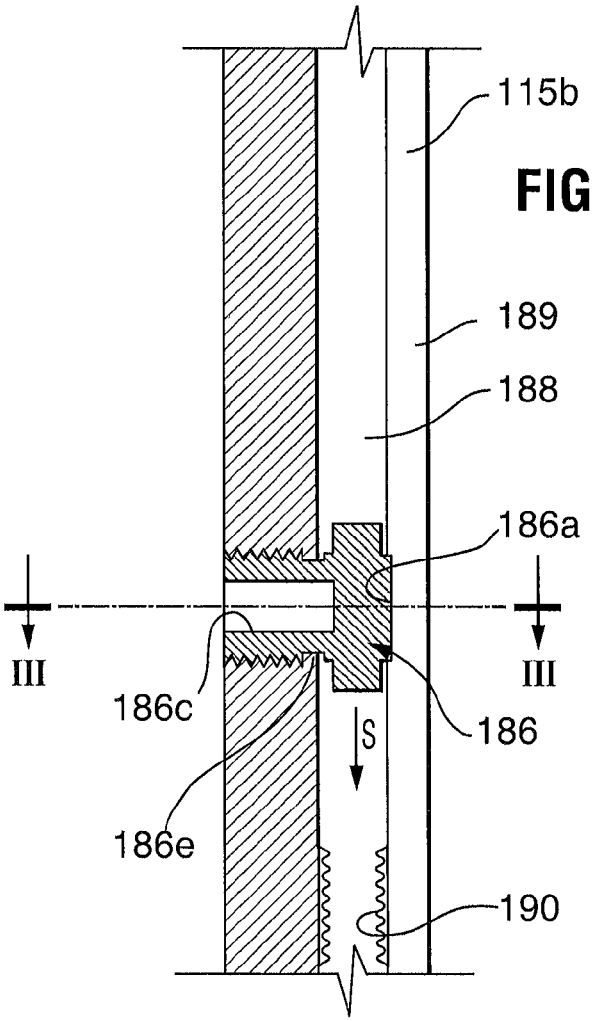
FIGS. 4A and 4B are schematic sectional drawings through a port with a port closure installed thereon.
Figure 4B:
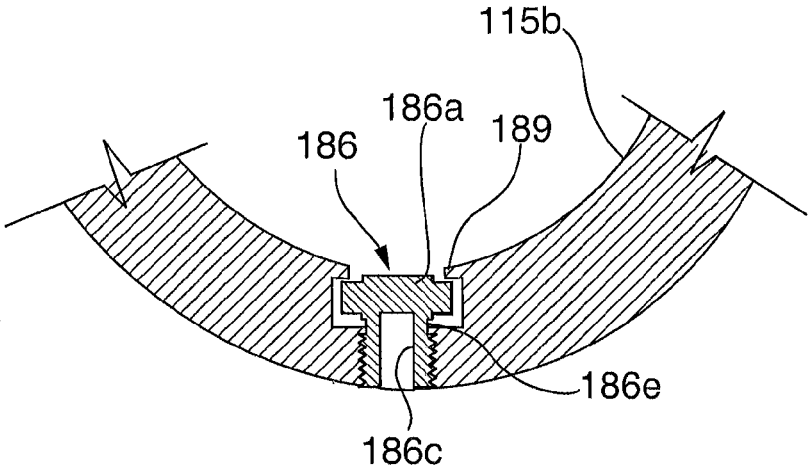

Another kobe plug closure is illustrated in FIGS. 4A and 4B, which is both shielded and captured. As shown, a kobe plug may be shielded by shielding wall such as for example, a recessed positioning in a slot with walls extending up alongside the kobe plug cap and/or by the provision of an extension of the wall inner surface surrounding the kobe plug that partially overlies the cap portion.

In the illustrated embodiment of FIG. 4, kobe plug 186 includes a shearable cap portion 186*a* that after shearing becomes captured in a holding area in the tubing string wall 115. In one embodiment, for example, kobe plug is 186 installed in a slot 188 in inner wall surface 115*b* such that cap portion 146*a* is recessed in the slot. In this embodiment, kobe plug can only be opened by inserting a port-opening tool structure (not shown) into the slot to apply a force, arrow S, to shear off the cap portion at the weakened shear plane 186*e*. In this embodiment, the slot's side walls include returns 189 that partially overlap cap portion 186*a*, While a port opening tool can be selected to pass through returns into the slot to contact the kobe plug cap 186*a*, returns 189 act as keepers, forming an opening to slot 188 that is smaller than the dimensions of cap portion 186*a*. Thus, even after being sheared off from the remainder of kobe plug, the cap portion is captured and cannot pass out of the slot. The sheared cap portion may simply be pushed aside in slot 188 such that the channel 186*c* of the kobe plug becomes opened. Alternately, slot 188 may be formed store the sheared cap in a fixed position away from the base. For example, slot 188 may be formed such that the sheared cap portion becomes frictionally jammed in a restricted portion 190, such as a narrowed or high friction (i.e. roughened, deformable, etc.) portion of the slot or a blind end of the slot. As another alternative, slot 188 may be formed to open into a cavity 191 in wall 115 in which the sheared cap portion can be retained. The slot may be formed to direct the sheared cap into the cavity or the cap may be formed to urge itself into the cavity. For example, the slot and/or the cap may include a deflection structure, as desired, to direct the sheared cap into the retaining cavity. Alternately, or in addition, the slot and/or the cap may be formed such that the cap can more readily move into the cavity than out of the cavity such that the cap is retained in the cavity. Capturing nubs, keys, restrictions, deflections, slots, etc. can be employed as desired in the slot and/or on the cap for this purpose.

Still other recessed and captured kobe plug closures can be employed, such as that shown in FIG. 5. In such a system, the cap portion 346*a* can be protected from abutment of tools and strings passing thereby and is removable from its port to open it and the sheared cap remains captured such that it is not released into the tubing string. For example, as shown, a port 316 can have a closure in the form of a kobe plug. The kobe plug includes a base portion 346*b* mounted in the port and a cap portion 346*a* that can be sheared from the mounted, base portion. An inner channel 346*c* extends up through the base portion and into cap portion 346*a*. While the channel opens on the end of the base portion at outer wall surface 315*a*, the channel is closed at its other end by cap portion 346*a*. The cap portion controls the ability of fluid to flow through the inner channel forming the port. In particular, when cap portion 346*a* is in place, connected to base portion 346*b*, fluid cannot flow through the port, it being prevented by the solid form of the cap and seals 346*d* encircling the base portion. However, when cap portion 346*a* is sheared from the base 346*b*, the channel is exposed and fluid can flow there through. While alternatives are possible, in one embodiment, the cap portions 346*a*, 346*b* may be formed as a unitary part and have a solid, fluid impermeable, but weakened area 346*e* between them.

A sleeve 380 is positioned over port 316 and cap 346. The sleeve includes an inner surface exposed in the inner diameter 318 of the tubing string 315 and an outer surface, facing the tubing string inner wall and including a surface indentation 380*a*. Indentation 380*a* is sized to accommodate cap portion 346*a* of the sleeve therein and is formed such that cap portion 346*a* remains at all times captured by the sleeve (i.e. cannot pass out from under the sleeve). Sleeve 380 is moveable within the tubing string inner bore from a position overlying the port and accommodating cap portion 346*a*, in indentation 380*a*. On its inner facing, exposed surface, the sleeve can be contacted by a sleeve shifting tool, a portion of which is indicated at 342. For example, sleeve 380 may include a shoulder 380*b* against which tool 342 can be located and apply force to move the sleeve. Sleeve 380 may be located in an annular recess 381 in order to ensure drift diameter in the tubing string. This positioning also protects the sleeve from inadvertent contact with tools during movement of such tools past the sleeve. Sleeve 380 can include a lock to ensure positional maintenance in the string. For example, sleeve 380 may carry a snap ring 382 positioned to land in a gland 388 in the tubing string inner wall, when the snap ring is aligned with the gland.

Sleeve 380 can be moved to shear the cap and open the port, while retaining the sheared cap portion 346*a* in the indentation. For example, during run in and before it is desired to open the port to fluid flow therethrough (FIG. 5A), the cap's cap portion 346*a* remains connected and sealed with base portion 346*b*. Sleeve 380 is positioned over the port with portion 346*a* positioned in indentation 380*a*.

Figure 5A:
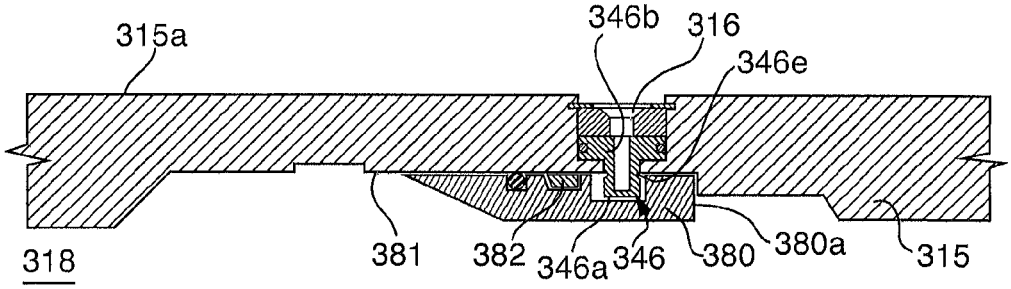
FIGS. 5A to 5D are sequential schematic sectional drawings along a port of a kobe sub showing the opening of a port closure using a port opening tool on a treatment string.
Figure 5B:
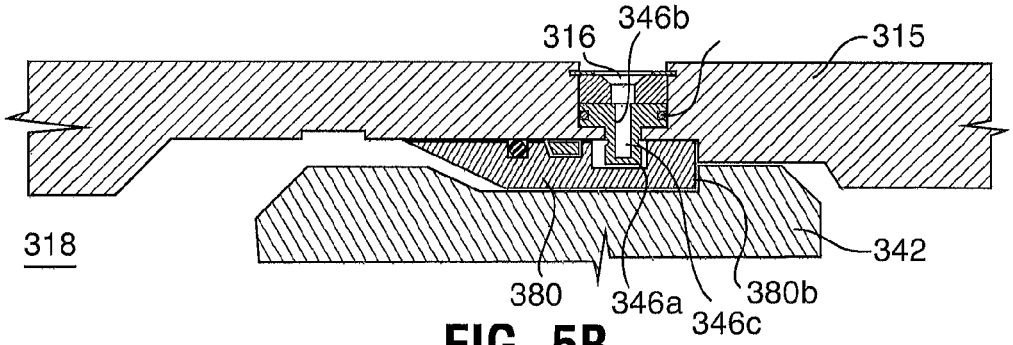
Figure 5C:
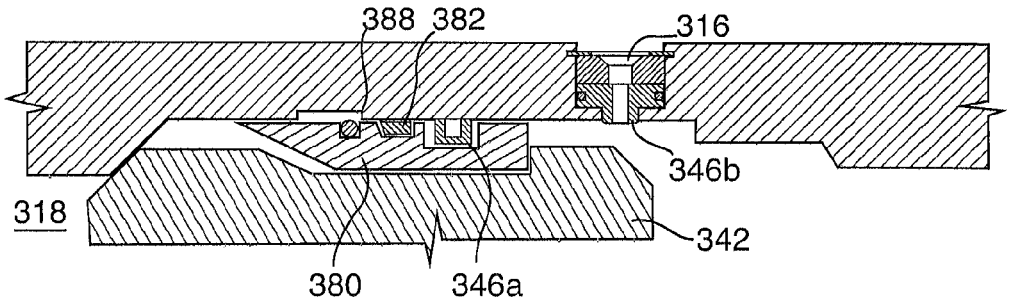

When it is desired to open the port, sleeve 380 can be moved, as by landing tool 342 against the sleeve, such as against shoulder 380*b* of the sleeve, (FIG. 5B) and, applying a push, pull or rotational force to the sleeve to move it along the tubing string (FIG. 5C). When sleeve 380 moves, force is applied to the cap cap portion 346*a* by abutment of the side walls of the indentation against portion 346*a*. Since cap portion 346*a* is urged to move, while base 346*b* is fixed, portion 346*a* becomes sheared from base portion 346*b*. While removal of cap portion 346*a* opens the port, the sleeve 380 with the sheared cap portion 346*a* captured therein can be slid until it fully exposes port to the inner bore. For example, sleeve 380 can be moved until it becomes locked, as by snap ring 382 landing in gland 388 in a displaced position, while cap portion 346*a* remains captured in indentation 380*a*.

Figure 5D:
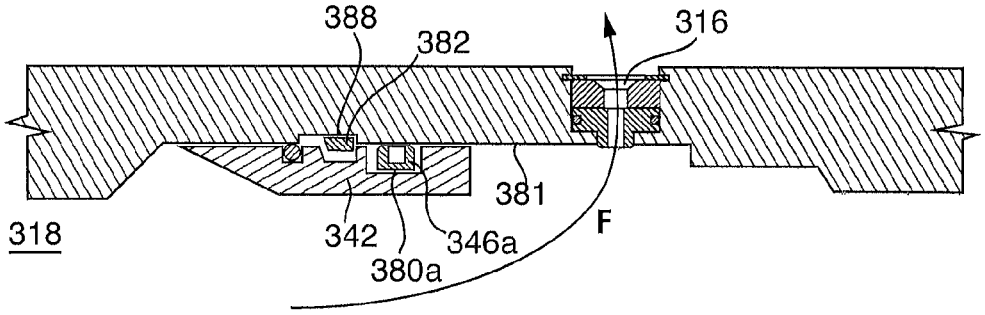

Fluid, such as fracing fluid F, may be pumped out through the channel forming port 316, which is exposed by opening the cap (FIG. 5D).

Another sub of a tubing string 415 is shown in FIG. 6, which includes a recessed and captured kobe cap closure 446. In this embodiment, the port opening tool is an actuation sleeve 440 (similar to a cutter sleeve), which is moveable along the tubing string by fluid pressure to act on the cap closure. Actuation sleeve 440 need not, therefore, be connected to surface.

Kobe cap 446 is similar to the kobe cap 346 of FIG. 5. For example, kobe cap 446 includes a base portion 446*b* mounted in a port 416 and a cap portion 446*a* that can be sheared from the base portion. An inner channel 446*c* extends up through the base portion and into cap portion 446*a* and the inner channel, while normally closed is opened by removal of the cap portion.

A sleeve 480, in this case in the form of a c-ring, is positioned over port 416 and cap 446. Forming the sleeve as a c-ring facilitates installation and, as will be described later, can simplify some other operations as well. The sleeve includes an inner surface exposed in the inner diameter 418 of tubing string 415 and an outer surface, facing the tubing string inner wall. An indentation 480*a* is formed on the outer surface, which is sized to accommodate cap portion 446*a* of the sleeve therein and is formed such that cap portion 446*a* remains at all times captured by the sleeve (i.e. cannot pass out from under the sleeve). Sleeve 480 is moveable within the tubing string inner bore from a position overlying the port and accommodating in indentation 480*a* the cap portion 446*a*, while it is still connected to base 446*b*. Sleeve 480 can be moved to apply a force against cap portion 446*a* to open the port, while retaining the sheared cap portion 446*a* in the indentation. Thus, when the sleeve is moved, the cap is sheared by the sleeve but the sheared cap is not released into the well and the sheared cap cannot interfere with intervention operations.

Sleeve 480 is moved by actuation sleeve 440. Sleeve 480 has a shoulder exposed in the inner bore that can be contacted by the actuation sleeve. For example, shoulder 480*b* protrudes slightly into the open diameter of string 415 and presents a surface against which the leading edge of actuation sleeve can engage and apply force to move sleeve 480. Sleeve 480 may be located in an annular recess 481 to provide some protection from inadvertent contact with tools moving past. Sleeve 480 may also be secured by a shear pin 483 to further protect it against inadvertent movement.

The assembly can include a lock mechanism ensure positional maintenance in the string. For example, the sub may include a gland 488 adjacent the installed location of kobe plug 446 into which sleeve 480 can be retained after it is moved to open the kobe plug. Since sleeve 480 is formed as a c-ring it can be selected to act as a snap ring with an ability to expand into gland 488, when the sleeve is aligned with the gland. An end wall 481*a* of recess 481 may be formed with an acute angular face to force the sleeve to expand out into the gland if it doesn't automatically do so. Once in gland 488, the spring force in the c-ring construction of sleeve 480 prevents the sleeve from slipping back over port 416.

Actuation sleeve 440 is positioned in tubing string 415 axially spaced from kobe cap 446 and includes a seat 451 against which a plug, such as a ball 452, as shown, a dart, etc., can be landed and seal. Actuation sleeve 440 can be driven to move by fluid pressure through tubing string 415 when plug 452 is landed on seat 451. Once the plug lands, a pressure differential is established that pushes the cutter assembly through inner bore 418 to act on sleeve 480. Actuation sleeve 440 can include seals 453 about its outer diameter that facilitate its pressure driven movement. Since actuation sleeve 440 presents an open bore, it substantially doesn't restrict access through it to the tubing string below. Thus, while the actuation sleeve could be introduced when needed, alternately, actuation sleeve 440 can be installed in the tubing string before it is run in and has no effect on operations until ball 452, or other plugging device, is landed in seat 451.

During run in and before it is desired to open port 416 to fluid flow therethrough (FIG. 6A), the cap's cap portion 446*a* remains connected and sealed with base portion 446*b* and sleeve 480 is positioned over the port with portion 446*a* positioned in indentation 480*a*.

When it is desired to open the port, sleeve 480 can be moved by launching ball 452 to land in actuation sleeve 440. Once the ball is landed in the seat of the actuation sleeve, actuation sleeve 440 is driven by fluid pressure to sleeve 480. When the actuation sleeve arrives at sleeve 480, it hits shoulder 480*a* (FIG. 6B) and overcomes the holding force of shear pin 483 to move sleeve 480. This shears cap portion 446*a* from the base to open channel 446*c*. (FIG. 6C) After it is sheared, cap portion 446*a* remains captured in indentation 480*a* and moves with sleeve 480.

Figure 6A:
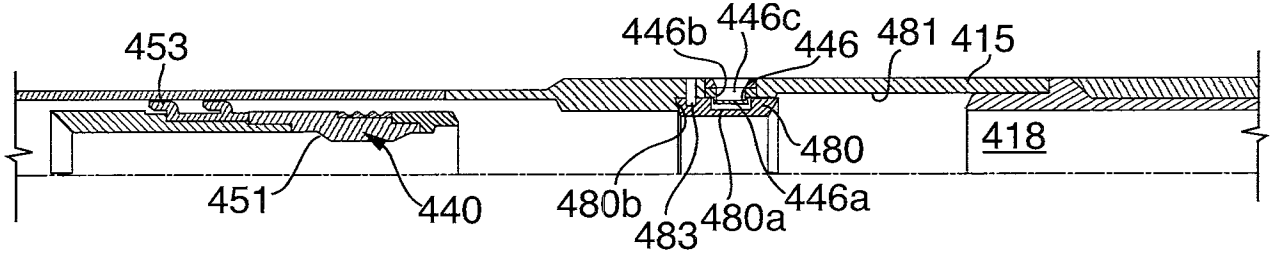
FIGS. 6A to 6E are sequential schematic sectional drawings along a port showing the opening of a port closure using a pressure conveyed tool.
Figure 6B:
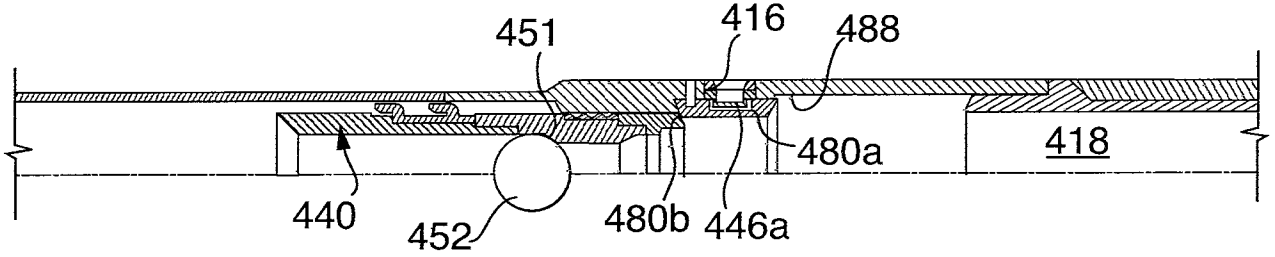
Figure 6C:
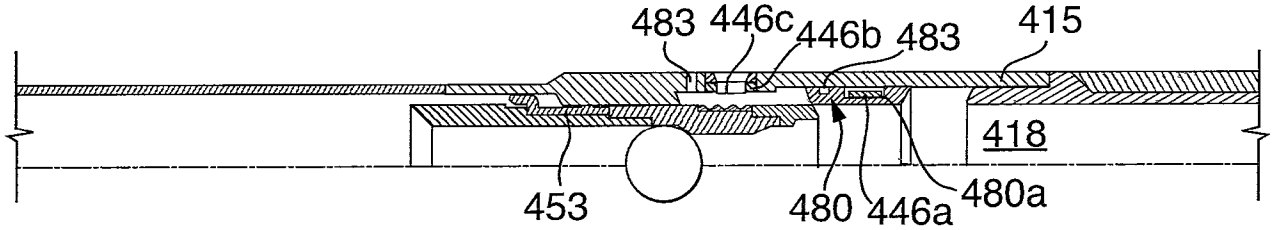
Figure 6D:
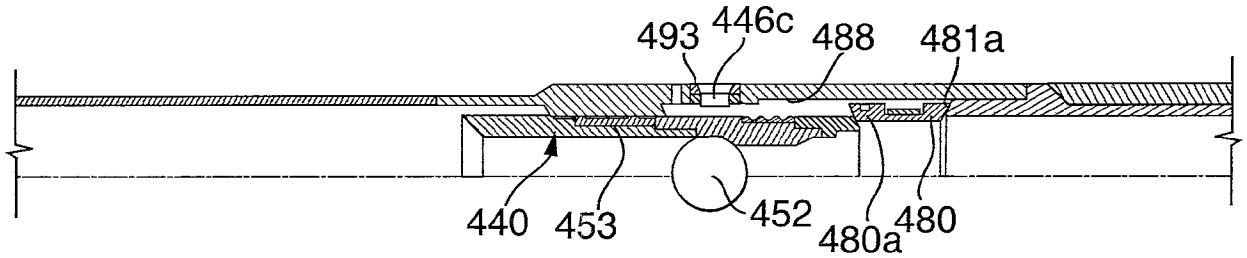
Figure 6E:
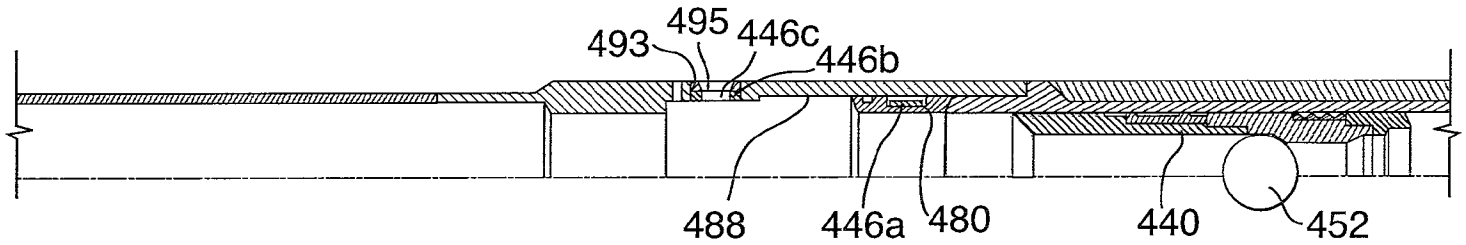

After it is sheared out, sleeve 480 may continue to be moved by actuation sleeve 440 until it is clear of channel 446*c* through the port. In this embodiment, sleeve 480 is moved over gland 488 and may expand into the gland (FIG. 6C). Actuation sleeve 440 can also be stopped in tubing string 415. Alternately, as shown, it may be intended that actuation sleeve 440 continues to move down the tubing string for other purposes downhole or to be stopped by a landing sub. Gland 488 may have a depth that permits sleeve 480 to expand out of reach of actuation sleeve 440 such that shoulder 480*b* moves out of contact with the actuation sleeve. If sleeve 480 fails to expand into gland 488, it will contact face 481*a* of recess 481 (FIG. 6D) and be forced to expand into gland 488 such that actuation sleeve 440 can move past (FIG. 6E).

As soon as cap portion 446*a* is sheared from base 446*c* (FIG. 6C), fluid has access to channel 446*c*. When seals 453 of the actuation sleeve are moved past the channel, fluid can be injected out through the channel. However, in some embodiments, for example, where actuation sleeve 440 requires pressure to be maintained, it may be desirable to restrict flow out through channel. As noted above, a limited entry nozzle 493 may be installed in port 416, such as may be formed of carbide or other hard materials and shaped to limit the flow through channel 446*c*. In addition or alternately, a further fluid flow limiter 495 may be employed such as a burst disc or an erosion washer. Limiter 495 restricts or prevents fluid flow through port 416 until a further force is applied to overcome the limiter. The force may be a burst pressure or an erosive force. For example, an erosion washer is formed of a material capable of being eroded in a fluid flow and includes a small diameter aperture therein. While limited fluid flow is permitted through the aperture, that flow causes erosion of the washer body to eventually permit full flow though channel, as limited by nozzle 493. Limiter 495 thus provides a delay suitable to maintain fluid pressure driving force for the actuation sleeve 440.

After use or whenever it is desired to remove the inner diameter constriction caused by actuation sleeve 440 in the well, the actuation sleeve may be milled up to provide a full ID access to tubing string 415. Thus, for example, the actuation sleeve can be manufactured from cast iron or polymeric materials which are millable. While millable, cast iron is less millable than some polymers. Thus, this invention utilizes a combination of materials to ensure proper durability but to facilitate milling. For example, a composite material can be used for the non-pressure containing section of the actuation sleeve, thus reducing the milling time for this part, while more durable materials such as cast iron are used for the pressure holding sections, like the seat.

Sleeve 480, which can become fully recessed in the tubing string, need not be milled.

The above-noted sub may be useful in an assembly where a plurality of ports are to be opened in the same operation. For example, with reference to FIG. 7, a string can be prepared with a plurality of kobe subs 409 each including one or more kobe plugs 446. The kobe plugs are each installed in a port through the kobe sub wall. The assembly may further include an actuation sleeve 440 installed on one side of plugs 446 and a catching sub 496 installed on the opposite side of plugs 446.

Kobe plugs 446 may have the form as described above with sleeves 480 installed thereover that can be sheared out by actuation sleeve 440 to, thereby, open flow channels through the kobe plugs. Fluid flow limiters 495 are also installed to limit fluid flow through the channels, once they are opened.

While FIG. 7 show only one series of ports to be opened by an actuation sleeve, it is noted that string 415 may include a number of similar intervals above and/or below that illustrated having one or more recessed and capture kobe-plugged ports and an actuation tool to open them.

Figures 7A, 7B, 7C, 7D, 7E, 7F, 7G:
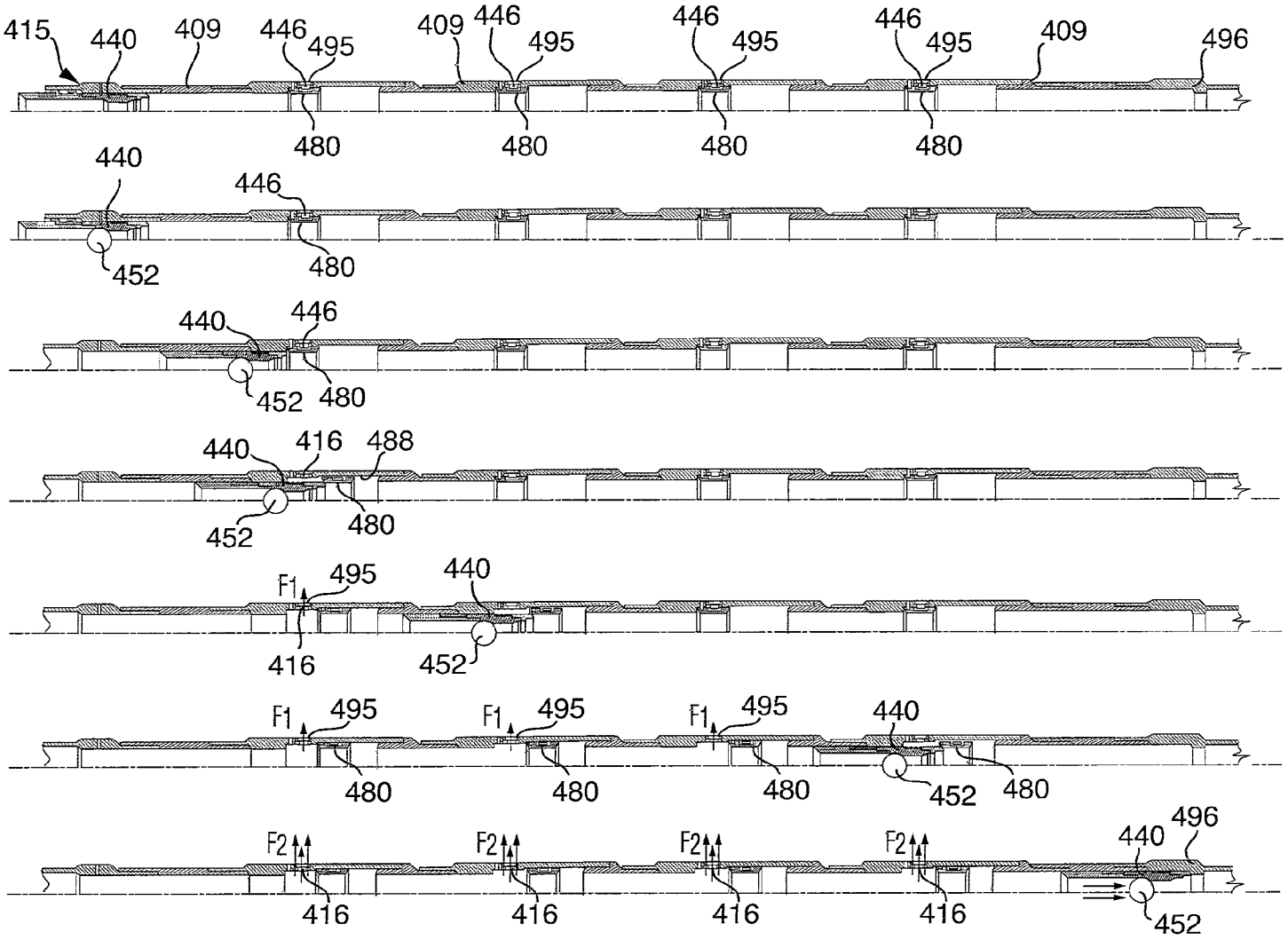
FIGS. 7A to 7G are sequential schematic sectional drawings along a tubing string showing the opening of a plurality of port closures using a pressure conveyed tool.

FIG. 7A shows the tubing string assembly as it is run in the well. Actuation sleeve 440 is pinned in a position axially spaced from subs 409. Kobe plugs 446 are intact and, therefore, sealed against fluid flow therethrough and their cap portions are each protected beneath sleeves 480. As it is usual to inject fluid from surface to pass through inner bore 418, when run in and positioned, actuation sleeve 440 is uphole from subs 409.

When it is desired to open the ports in which kobe plugs are installed, a plug such as ball 452 is launched and lands in the seat of sleeve 440 (FIG. 7B). The pressure differential that is generated shears out actuation sleeve 440 and drives it through the string.

When actuation sleeve 440 arrives at the first kobe plug (FIG. 7C), the actuation sleeve hits the shoulder of sleeve 480 and shears the sleeve free of its pinned connection, which shears off the cap portion of the kobe plug to open access to its channel 416 (FIG. 7D). The actuation sleeve continues to push sleeve 480 until it expands into its gland 488.

Actuation sleeve 440 continues on through tubing string 415. It is noted that once the cap portion of the kobe plug is sheared, channel 416 is open to fluid flow. However, fluid flow limiters 495 can be employed to maintain sufficient pressure holding capability in the string. For example, limiters 495 here are illustrated as erosion washers that permit a small amount of fluid arrow F1 to pass, but any pressure loss by such flow is insufficient to stop the movement of actuation sleeve 440. Thus, actuation sleeve 440 continues, as driven by fluid pressure, and shears the remaining sleeves 480 to open the remaining kobe plugs (FIG. 7F). Eventually, as shown in FIG. 7G, actuation sleeve 440 lands on the catching sub 496 where it hits a shoulder and is stopped. Since actuation sleeve 440 with ball 452 therein creates a seal against fluid passage, actuation sleeve 440 creates a seal that pressure isolates the tubing string below from that above and diverts fluid pressure to the opened channels 416 of the kobe plugs.

As noted, limiters 495 permit a small amount of fluid (arrows F1) to pass once the kobe plugs are opened, but eventually the flow erodes the limiters such that substantially full flow (arrows F2) is achieved. Limiters 495 provide for delayed opening of the channels to ensure the pressure holding capability of the string is maintained long enough that the actuation sleeve can act on all the kobe plugs in the series.

A further variation of a recessed and captured kobe plug is similar to that of FIG. 7 but doesn't use an intermediate actuation sleeve. Instead, a plug, such as a ball, a dart or the like, is used as the port opening tool to directly actuate the protecting sleeve for the kobe plug. As such, this kobe sub is directly ball actuated.

In such a system, the kobe plug cap is protected from abutment of tools and strings passing thereby by a sleeve, but once removed to open the port in which it is installed, the cap remains captured such that it is not released into the tubing string nor into the annulus. In this embodiment, the sleeve shielding the kobe plug includes a ball seat formed on its inner diameter. A ball can be launched to hit the seat, the ball being selected to have a diameter greater than that of the diameter of the seat. Once the ball hits the seat the diameter differential ensures that the ball at least initially cannot pass though the seat and that force is translated to the sleeve under which the kobe plug is protected. The force moves the sleeve, which shears the top of the kobe plug to access the annulus of the tubing. This access allows the formation about the string to be treated, for example fraced.

A system of these captured kobes can be used to stimulate a large section along the well since the ball seat and or ball can be formed to be deformable to allow the ball to act on a number of ball seats as it travels along the string and the ports can be configured to be substantially pressure holding, even after opening, as restricted by nozzles, flow limiters such as an erosion washer (i.e. an erodible disk with a small hole through it), etc. to ensure that sufficient pressure can be maintained to move the ball and the sleeves. Once the ball has opened all of the kobe sleeves it lands on, fluid can be diverted to the opened ports. A seal may be established in the string below the opened kobe plugs to pressure isolate the opened ports from ports below and to assist in the diversion of fluid to the opened ports. For example, where collapsible ball seats are employed on the kobe protecting sleeves, a non-collapsible ball seat may be installed in the string. In one embodiment, the non-collapsible ball seat may serve a dual purpose, for example, it may be the ball seat of a standard sleeve closed port and may open that port as well once it lands.

Erosion washers and nozzles may be employed together. In such a combination, the erosion washers initially substantially prevent flow though the ports. As the stimulation progresses, however, the discs erode away leaving the port fully open to the diameter of the nozzle.

Such a recessed and captured kobe plug is shown in FIG. 8. As noted above, in this embodiment, a pressure conveyed plug 542, such as a ball as shown, is used alone as the port opening tool. Thus, each sleeve 580, that shields the kobe plug cap portion 546*a*, includes a ball seat 380*b* that catches the ball to move the sleeve.

For example, as shown, a sub including a tubular wall 515 with a port 516 through its wall may include an upper end 515*a* and a lower end 515*b* each formed for connection into a tubing string. Port 516 can have a closure in the form of a kobe plug. The kobe plug includes a base portion 546*b* mounted in the port and a cap portion 546*a* that can be sheared from the mounted, base portion. An inner channel extends up through the base portion and into cap portion 546*a*, but is closed by cap portion. The integrity of cap portion controls the ability of fluid to flow through the inner channel forming the port. In particular, when cap portion 546*a* is in place, connected to base portion 546*b*, fluid cannot flow through the port, that flow being prevented by the solid form of the cap portion and the seals encircling the base portion. However, when cap portion 546*a* is sheared from the base 546*b*, the channel is exposed and fluid can flow through the channel, which creates the flow opening of port 516 between inner bore 518 and outer surface 520, which is open to the formation 512.

While alternatives are possible, in one embodiment, the cap portions 546*a*, 546*b* may be formed as a unitary part and have a solid, fluid impermeable, but weakened area between them.

A sleeve 580 is positioned over port 516 and kobe plug 546. The sleeve includes an inner surface exposed in the inner diameter 518 of the tubing string 515 and an outer surface, facing the tubing string inner wall and including a surface indentation 580*a*. Indentation 580*a* is sized to accommodate cap portion 546*a* of the kobe plug therein and is formed such that cap portion 546*a* remains at all times captured by the sleeve (i.e. cannot pass out from under the sleeve). Sleeve 580 is moveable within the tubing string inner bore from a position overlying the port and accommodating cap portion 546*a* while it is still connected to the base portion, in indentation 580*a*. On its inner facing, exposed surface, the sleeve can be contacted by a sleeve shifting tool, such as a fluid conveyed plug 542 (such as a ball, a dart or the like). For example, sleeve 580 may include a seat 580*b* against which plug 542 can be landed and can create a substantial seal to establish a pressure differential across the sleeve. The pressure differential, once established, applies a force to move the sleeve.

Although not shown, sleeve 580 may be located in an annular recess in order to enlarge the drift diameter in the tubing string. This positioning also protects the sleeve from inadvertent contact with tools during movement of such tools past the sleeve.

Sleeve 580 can include a lock to ensure positional maintenance in the string. For example, sleeve 580 also may pinned, as by a shear pin (not shown), to further act against inadvertent movement out of its initial run in position. Alternately or in addition, sleeve 580 may have a lock that engages after the sleeve has been moved to open the kobe plug. For example, sleeve 580 may carry a snap ring 582 positioned to land in a gland 588 in the tubing string inner wall, when the snap ring is aligned with the gland.

Sleeve 580 can be moved to shear the cap and open the port, while retaining the sheared cap portion 546*a* in the indentation. For example, during run in and before it is desired to open the port to fluid flow therethrough (FIG. 8A), the cap's cap portion 546*a* remains connected and sealed with base portion 546*b* and sleeve 580 is positioned over the port with portion 546*a* positioned in indentation 580*a*.

Figure 8A:
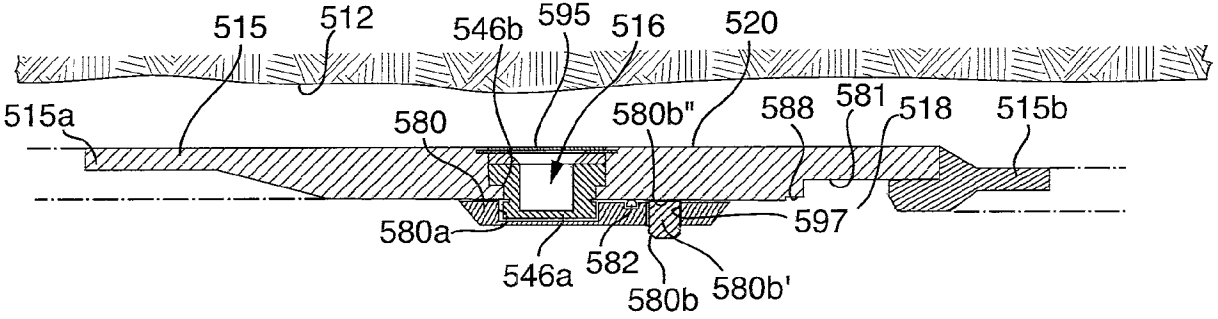
FIGS. 8A to 8G are sequential schematic sectional drawings along a port showing the opening of a port closure using a pressure conveyed plug.
Figure 8B:
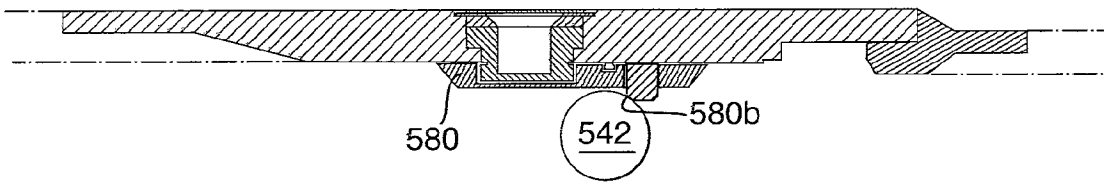
Figure 8C:
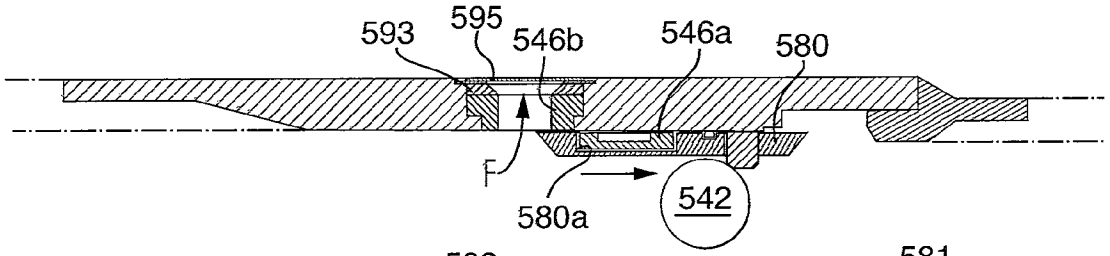

When it is desired to open the port, sleeve 580 can be moved, as by landing a plug 542 against the sleeve, such as seat 580*b* of the sleeve, (FIG. 8B) and, applying a push force to the sleeve to move it along the tubing string (FIG. 8C). When sleeve 580 moves, force is applied to the cap portion 546*a* by abutment of the side walls of the indentation against portion 546*a*. Since cap portion 546*a* is urged to move, while base 546*b* remains fixed, portion 546*a* becomes sheared from base portion 546*b*. While removal of cap portion 546*a* opens the port and some amount of fluid can pass under the sleeve, which has no seals, and out through port, the sleeve 580 with the sheared cap portion 546*a* captured therein can be slid until it fully exposes port to the inner bore. For example, sleeve 580 can be moved until it becomes locked, as by snap ring 582 landing in gland 588, in a displaced position, while cap portion 546*a* remains captured in indentation 580*a*.

Figure 8D:
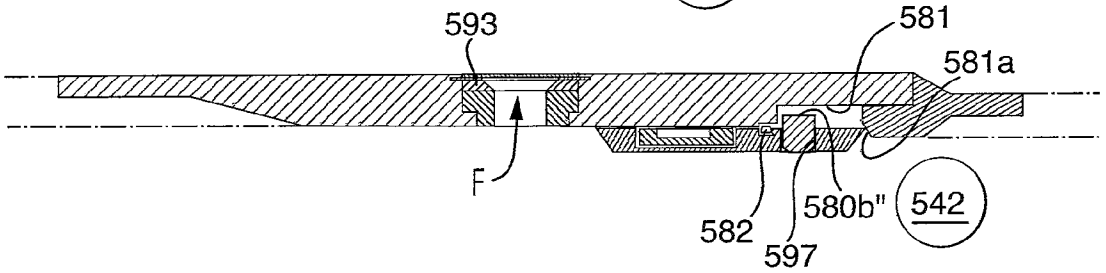
Figure 8E:
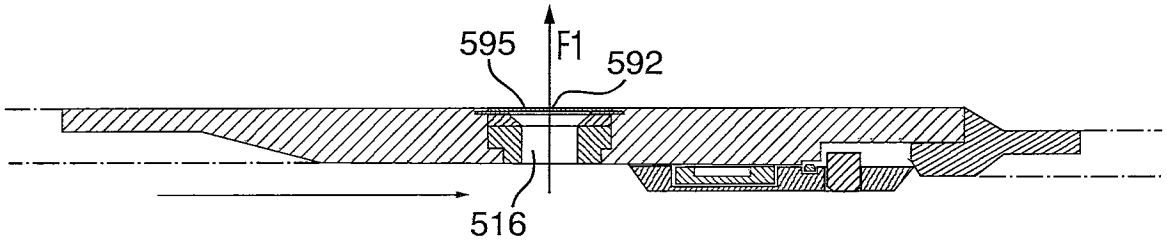

Fluid, such as fracing fluid F, may be pumped out through the channel forming port 516, which is exposed by opening the cap (FIG. 8D).

Figure 8F:
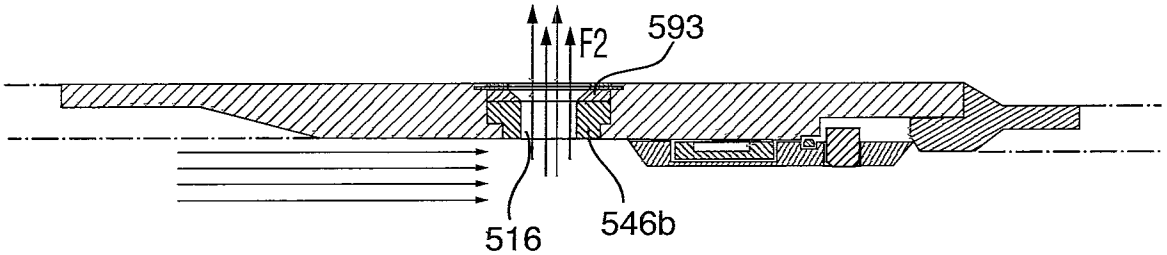

After the sleeve moves, the plug 542 can pass through the sleeve to continue downhole, where it may actuate further sleeves and/or land to create a seal. In this embodiment, for example, seat 580*b* is formed to be collapsible such that once it has been employed to move the sleeve; the seat can be overcome by the plug to allow it to pass further downhole. Seat 580*b* may for example be formed of protrusions such as dogs that, while initially supported in an active position, may be collapsed radially outwardly, after the sleeve moves. The protrusions, for example, can include a protruding end 580*b*' and a back end 580*b*" and can be carried in slots 597 in the sleeve. The protrusions, while retained in the slots, can slide radially in and out through the slots. When seat 580*b* is active, the protrusions protrude inwardly into the inner diameter of the sleeve to define the active diameter of the seat. However, a recess 581 is formed in the tubing body and is positioned relative to the sleeve and the protrusions such that, the protrusions can drop into the recess after the sleeve is moved, arrow M, by the plug. When the protrusions drop into the recess, they retract out of a blocking position for the plug and the plug is free to move past the protrusions (FIG. 8D).

Where a plurality of ports are to be opened by plug 542 along the length of the tubing string, the system may use a limited entry type technique to ensure the frac fluid is appropriately distributed between the ports and to ensure that sufficient pressure is retained to continue to move plug 542 through the string. In a limited entry system, a sized nozzle 593 is installed in at least some of the ports in the series to allow distribution of the fluid in an appropriate and planned manner through all the ports in the series that are to be opened and fraced simultaneously. In one embodiment, as shown, another limiting system may be employed in addition to, or alternately from, nozzles 593. The limiting system may employ pressure holding limiters, such as burst plugs or erosion disks 595, to ensure that sufficient pressure is retained to continue to move the plug through the string and to move the sleeves even after one or more caps are sheared. After the cap 546*a* is removed, the port is opened except as restricted by disk 595 (FIG. 8E) and the port will not fully open (FIG. 8F) until the disk breaks down. In the illustrated embodiment, disk 595 includes a fluid escape port 592 that initially allows a flow of high pressure fluid Fl to escape through the disk. Port 592 creates a site for erosion and the erosion breaks down the disk over time, until it is fully opened. When fully opened, a full orifice frac flow F2, can be injected through port 516 and nozzle 593 therein (FIG. 8F). The eroding properties of the disk may be selected to ensure that port 516 remains substantially closed for long enough that the plug has moved through its intended path and opened all intended kobe plugs.

The sleeve can include an end 580*c* formed to engage against a stop shoulder 581*a* in the tubing string wall. End 580*c* or wall 581*a* may be selected, as by angular forming, to properly direct the sleeve radially outwardly to prevent inward collapsing damage to the sleeve.

Figure 8G:
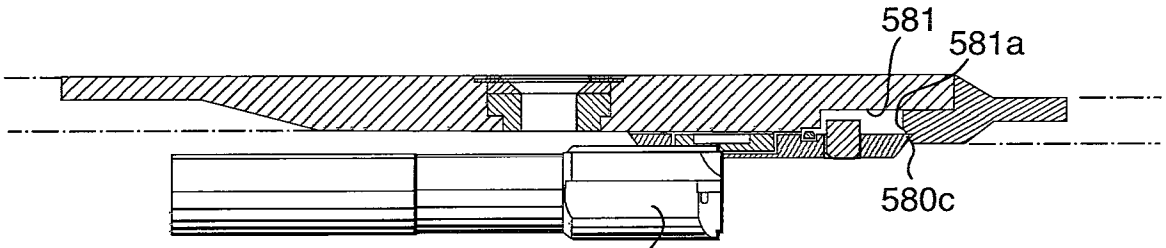

If sleeve 580 or any part of the sleeve is not suitably recessed in the wall 515 of the kobe sub, the protruding part can be milled out, as desired (FIG. 8G). The sleeve, recess 581 and/or shoulder 581*a* may be selected to keep the sleeve from turning during milling. For example, as shown, end 580*c* may be formed, as by sharpening, tipping with spikes or cutters, faceting, etc., to become rotationally locked in the string to keep it from turning.

A ball seat can be employed below the lower most kobe plug in the series that creates a seal with plug 542 to isolate the series of opened kobe plugs so that fluid can be diverted to the opened ports.

While the embodiment of FIG. 8 shows a system using collapsible ball seats on the sleeves, it is to be appreciated that similar result could be achieved by employing a collapsible ball with appropriate non-collapsing ball seats on the kobe shielding sleeves. The collapsible ball may be selected to squeeze through the ball seats but in so doing exert a sufficient force to move the sleeves. Where a plurality of sleeves is to be opened in one operation, the collapsible ball may be formed to be resilient and therefore able to act on a plurality of seats along the string.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

We claim:

1. A kobe sub comprising: a tubular body connectable into a wellbore tubing string, the tubular body including a wall including an outer surface and an inner surface defining an inner bore and a port through the wall; a kobe plug installed in the port including a base mounted in the port, a cap portion accessible in the inner bore and connected to the base and a channel extending through the base and closed by the cap portion, the cap portion being removable from the base to open the channel to allow fluid passage though the channel from the inner bore to the outer surface; and a capturing mechanism to capture the cap portion from becoming loose in the inner bore after the cap portion is removed from a sealing position on the base.

2. The kobe sub of claim 1 wherein the capturing mechanism causes the cap portion to be pushed outwardly into the channel toward the outer surface.

3. The kobe sub of claim 1 wherein the cap portion breaks outwardly into the channel and is pushed out by fluid flow through the channel.

4. The kobe sub of claim 1 wherein the cap portion is a plug installed in the channel and the channel is tapered inwardly to a diameter less than the plug to prevent the plug from becoming loose in the inner bore.

5. The kobe sub of claim 1 wherein the capturing mechanism stores the cap portion in the sub.

6. The kobe sub of claim 1 wherein the capturing mechanism includes a hinge between the cap portion and the base that secures the cap portion to the base after the cap portion is removed from a sealing position on the base.

7. The kobe sub of claim 1 wherein the capturing mechanism includes an extension of the wall inner surface overlying a portion of the cap portion that retains the cap portion after the cap portion is removed from a sealing position on the base.

8. The kobe sub of claim 1 wherein the kobe plug is positioned in a slot formed in the inner surface and the capturing mechanism includes a return overlying a portion of the cap portion to prevent the cap portion from passing out of the slot after the cap portion is removed from a sealing position on the base.

9. The kobe sub of claim 1 wherein the capturing mechanism includes a sleeve installed in the inner bore and positioned to overlie at least a portion of the cap portion and including a cavity in the sleeve that retains the cap portion after the cap portion is removed from a sealing position on the base.

10. The kobe sub of claim 9 wherein the sleeve overlies the cap portion and the cavity is an indentation in an underside of the sleeve.

11. The kobe sub of claim 9 wherein the sleeve is moveable to abut against the cap portion to remove the cap portion from a sealing position on the base.

12. The kobe sub of claim 9 wherein the sleeve includes a shoulder against which a port opening tool pushes to move the sleeve.

13. The kobe sub of claim 12 wherein the shoulder is a ball seat and the port opening tool is a plug sized to land and seal in the ball seat.

14. The kobe sub of claim 1 wherein the capturing mechanism collects the cap portion in a port opening tool.

15. The kobe sub of claim 1 further comprising a shielding structure in the inner bore to shield the cap portion from protruding unprotected into the inner bore.

16. The kobe sub of claim 15 wherein the shielding structure includes a shielding wall extending alongside the cap portion.

17. The kobe sub of claim 16 wherein the shielding wall is a sidewall of a slot formed in the wall inner surface.

18. The kobe sub of claim 17 wherein the sidewall defines a slot depth and the slot depth is greater than the height of the cap portion such that the cap portion is fully recessed in the slot.

19. The kobe sub of claim 17 wherein the slot includes a return overlying a portion of the cap portion.

20. The kobe sub of claim 16 wherein the shielding wall includes an extension of the wall inner surface overlying a portion of the cap portion.

21. The kobe sub of claim 15 wherein the shielding structure is a sleeve installed in the inner bore and positioned to overlie at least a portion of the cap portion.

22. The kobe sub of claim 1 further comprising a flow limiting device in the channel for at least restricting flow through the channel and for providing a delay before the port becomes fully open to fluid flow.

23. The kobe sub of claim 22 wherein the flow limiting device is removed by erosion.

24. A method for forming a fluid channel through a tubing string wall, the method comprising: installing a tubing string in a wellbore, the tubing string including a tubular wall including an outer surface and an inner surface defining an open inner bore and a port through the wall; and a kobe plug installed in the port including a base mounted in the port, a cap portion accessible in the inner bore and connected to the base and a channel extending through the base and closed by the cap portion, the cap portion being removable from the base to open the channel to allow fluid passage though the channel from the inner bore to the outer surface; introducing a port opening tool into the inner bore; manipulating the tool to remove the cap portion from a sealing positon on the base to open the channel; and capturing the cap portion to prevent the cap portion from becoming loose in the inner bore.

25. The method of claim 24 wherein capturing the cap portion includes collecting the cap portion in the tool after it is removed from the base.

26. The method of claim 24 further comprising a hinge between the cap portion and the base, manipulating the tool includes applying a force to break the cap portion away from the base to pivot the cap portion about the hinge and capturing includes storing the cap portion connected to the base through the hinge.

27. The method of claim 24 wherein capturing includes storing the cap portion in the tubing string.

28. The method of claim 27 further comprising an extension of the inner surface overlying a portion of the cap portion and storing includes storing the cap portion in a position retained by the extension after the cap portion is removed from a sealing position on the base.

29. The method of claim 27 further comprising a slot in which the kobe plug is positioned with a return overlying a portion of the cap portion and storing includes positioning the cap portion in a position retained by the return after it is removed from a sealing position on the base.

30. The method of claim 27 further comprising a slot in which the kobe plug is positioned with a return overlying a portion of the cap portion and storing includes moving the cap portion into a frictionally jammed position in the slot.

31. The method of claim 27 further comprising a slot in which the kobe plug is positioned with a return overlying a portion of the cap portion and storing includes moving the cap portion along the slot to a retaining cavity.

32. The method of claim 27 further comprising a sleeve installed in the inner bore and positioned to overlie at least a portion of the cap portion and storing includes retaining the cap portion in a position under the sleeve after the cap portion is removed from a sealing position on the base.

33. The method of claim 24 further comprising a sleeve installed in the inner bore and wherein manipulating the tool includes moving the sleeve to abut against the cap portion to remove the cap portion from a sealing position on the base and storing includes retaining the cap portion with the sleeve.

34. The method of claim 33 wherein the sleeve includes a shoulder and manipulating the tool includes applying a force against the shoulder to move the sleeve.

35. The method of claim 34 wherein applying a force includes landing a tool against the shoulder and generating a pressure differential to apply a pressure driven force.

36. The method of claim 24 wherein capturing includes pushing the cap portion out through the channel away from the inner bore.

37. The method of claim 24 wherein manipulating the tool includes breaking the cap portion from a sealing position on the tool and capturing includes applying a force with the tool to push the cap portion outwardly into the channel and urging the cap portion out of the channel by fluid flow through the channel.

38. The method of claim 24 further comprising shielding the cap portion against inadvertent applications of force before manipulating the tool.

39. The method of claim 24 further comprising manipulating the tool to open a second kobe plug axially spaced from the kobe plug to form a second fluid channel through the tubing string wall.

40. The method of claim 39 wherein the tool moves from the kobe plug to the second kobe plug while moving along the tubing string.

41. The method of claim 24 wherein manipulating the tool includes manipulating a string on which the tool is carried.

42. The method of claim 24 wherein manipulating the tool includes pumping the tool through the tubing string and applying a pressure driven force to remove the cap portion from a sealing position over the base.

43. The method of claim 42 wherein the tool lands against a sleeve over the cap portion and the pressure driven force drives the sleeve against the cap portion to remove the cap portion from a sealing position over the base.

44. A tubing string system for installation in a wellbore comprising: a tubular body including a tubular wall with an outer surface and an inner surface defining an open inner bore and a port through the wall; a kobe plug installed in the port including a base mounted in the port, a cap portion accessible in the inner bore and connected to the base and a channel extending through the base and closed by the cap portion, the cap portion being removable from the base to open the channel to allow fluid passage though the channel from the inner bore to the outer surface; a port opening tool for removing the cap portion from a sealing position on the base; and a capturing mechanism to capture the cap portion from becoming loose in the inner bore after the cap portion is removed from the sealing position on the base.

45. The tubing string system of claim 44 wherein the capturing mechanism includes a structure on the port opening tool that pushes the cap portion outwardly into the channel toward the outer surface when removing the cap portion from the sealing position on the base.

46. The tubing string system of claim 44 wherein the capturing mechanism includes a configuration of the kobe plug that urges the cap portion outwardly into the channel toward the outer surface when the cap portion is removed from the sealing position on the base.

47. The tubing string system of claim 44 wherein the capturing mechanism stores the cap portion in the sub.

48. The tubing string system of claim 44 wherein the capturing mechanism includes a hinge between the cap portion and the base that secures the cap portion to the base after the cap portion is removed from the sealing position on the base.

49. The tubing string system of claim 44 wherein the capturing mechanism includes an extension of the wall inner surface overlying a portion of the cap portion that retains the cap portion after it is removed from the sealing position on the base.

50. The tubing string system of claim 44 wherein the kobe plug is positioned in a slot formed in the inner surface and the capturing mechanism includes a return overlying a portion of the cap portion to prevent the cap portion from passing out of the slot after the cap portion is removed from a sealing position on the base.

51. The tubing string system of claim 44 wherein the capturing mechanism includes a sleeve installed in the inner bore and positioned to overlie at least a portion of the cap portion and including a cavity in the sleeve that retains the cap portion after the cap portion is removed from a sealing position on the base.

52. The tubing string system of claim 51 wherein the sleeve overlies the cap portion and the cavity is an indentation in an underside of the sleeve.

53. The tubing string system of claim 51 wherein the sleeve is moveable to abut against the cap portion to remove the cap portion from a sealing position on the base.

54. The tubing string system of claim 51 wherein the port opening tool is a plug and the sleeve includes a seat for retaining the plug such that a pressure driven force is generated to move the sleeve.

55. The tubing string system of claim 51 wherein the sleeve includes a shoulder against which the port opening tool pushes to move the sleeve.

56. The tubing string system of claim 55 wherein the shoulder is a ball seat and the port opening tool is a plug sized to land and seal in the ball seat.

57. The tubing string system of claim 44 wherein the capturing mechanism is a portion of the port opening tool that collects the cap portion.

58. The tubing string system of claim 44 further comprising a shielding structure in the inner bore to shield the cap portion from protruding unprotected into the inner bore.

59. The tubing string system of claim 58 wherein the shielding structure includes a shielding wall extending alongside the cap portion.

60. The tubing string system of claim 59 wherein the shielding wall is a sidewall of a slot formed in the wall inner surface.

61. The tubing string system of claim 60 wherein the sidewall defines a slot depth and the slot depth is greater than the height of the cap portion such that the cap portion is fully recessed in the slot.

62. The tubing string system of claim 60 wherein the slot includes a return overlying a portion of the cap portion.

63. The tubing string system of claim 59 wherein the shielding wall includes an extension of the wall inner surface overlying a portion of the cap portion.

64. The tubing string system of claim 58 wherein the shielding structure is a sleeve installed in the inner bore and positioned to overlie at least a portion of the cap portion.

65. The tubing string system of claim 44 wherein the port opening tool is carried on a string.

66. The tubing string system of claim 44 wherein the port opening tool is conveyed through the tubing string by fluid pressure.

67. The tubing string system of claim 44 further comprising a flow limiting device in the channel for at least restricting flow through the channel and for providing a delay before the port becomes fully open to fluid flow.

68. The tubing string system of claim 67 wherein the flow limiting device is removed by erosion.

69. The tubing string system of claim 44 further comprising a second kobe plug axially spaced along the tubing string from the kobe sub and a second shielding structure for the second kobe plug; and the port opening tool also is operable to overcome the second shielding structure to open the kobe plug.

70. The tubing string system of claim 44 wherein the kobe plug is one in a series of kobe plugs spaced axially along the tubing string, the series of kobe plugs being configured to be acted upon by the port opening tool in sequence in one operation.

71. A kobe sub comprising: a tubular body connectable into a wellbore tubing string, the tubular body including a wall including an outer surface and an inner surface defining an inner bore and a port through the wall; a kobe plug installed in the port with a cap portion accessible in the inner bore, a base mounted in the port and connected to the cap portion, a channel extending through the base and closed by the cap portion; and a slot formed in the wall inner surface in the inner bore with a sidewall of the slot shielding the cap portion from protruding into the inner bore.

72. The kobe sub of claim 71 wherein the sidewall defines a slot depth and the cap portion has a height, and the slot depth is greater than the height of the cap portion such that the cap portion is fully recessed in the slot.

73. The kobe sub of claim 71 wherein the slot includes a return overlying a portion of the cap portion.

74. The kobe sub of claim 71 wherein the sidewall is an extension of the wall inner surface overlying a portion of the cap portion.

75. A kobe sub comprising: a tubular body connectable into a wellbore tubing string, the tubular body including a wall including an outer surface and an inner surface defining an inner bore and a port through the wall; a kobe plug installed in the port with a cap portion accessible in the inner bore, a base mounted in the port and connected to the cap portion, a channel extending through the base and closed by the cap portion; and a sleeve installed in the inner bore and positioned to overlie at least a portion of the cap portion, the sleeve including a shoulder against which a port opening tool pushes to move the sleeve, wherein the shoulder is a ball seat and the port opening tool is a plug sized to land and seal in the ball seat.

76. A kobe sub comprising: a tubular body connectable into a wellbore tubing string, the tubular body including a wall including an outer surface and an inner surface defining an inner bore and a port through the wall; a kobe plug installed in the port with a cap portion accessible in the inner bore, a base mounted in the port and connected to the cap portion, a channel extending through the base and closed by the cap portion; a shielding structure in the inner bore to shield the cap portion from protruding into the inner bore; and, cap portion capturing mechanism to capture the cap portion from becoming loose in the inner bore after the cap portion is removed from the base.

77. The kobe sub of claim 76 wherein the cap portion capturing mechanism pushes the cap portion outwardly through the channel toward the outer surface.

78. The kobe sub of claim 76 wherein the cap portion capturing mechanism stores the cap portion in the sub.

79. The kobe sub of claim 76 wherein the shielding structure is a sleeve installed in the inner bore and positioned to overlie at least a portion of the cap portion and the cap portion capturing mechanism is a cavity in the sleeve that retains the cap portion after the cap portion is removed from the base.

80. The kobe sub of claim 76 wherein the shielding structure is a slot formed in the wall inner surface and the cap portion capturing mechanism includes a return overlying a portion of the cap portion to prevent the cap portion from passing out of the slot after it is removed from the base.

81. A kobe sub comprising: a tubular body connectable into a wellbore tubing string, the tubular body including a wall including an outer surface and an inner surface defining an inner bore and a port through the wall; a kobe plug installed in the port with a cap portion accessible in the inner bore, a base mounted in the port and connected to the cap portion, a channel extending through the base and closed by the cap portion; a shielding structure in the inner bore to shield the cap portion from protruding into the inner bore; and, a flow limiting device in the channel for at least restricting flow through the channel and for providing a delay before the port becomes fully open to fluid flow.

82. The kobe sub of claim 81 wherein the flow limiting device is removed by erosion.

83. A method for forming a fluid channel through a tubing string wall, the method comprising: installing a tubing string in a wellbore, the tubing string including a tubular wall including an outer surface and an inner surface defining an open inner bore and a port through the wall; a kobe plug installed in the port with a cap portion accessible in the inner bore, a base mounted in the port and connected to the cap portion, a channel extending through the base and closed by the cap portion; and a shielding structure in the inner bore to shield the cap portion from protruding into the inner bore, the shielding structure including a shielding wall extending alongside the cap portion; introducing a port opening tool into the inner bore; manipulating the tool to overcome the shielding structure; and removing the cap portion to open the channel and form the fluid channel though the tubing string wall, wherein manipulating the tool includes reaching past the shielding wall to remove the cap portion.

84. The method of claim 83 wherein the shielding wall is a sidewall of a slot formed in the inner surface and manipulating the tool includes reaching into the slot to remove the cap portion.

85. The method of claim 83 further comprising manipulating the tool to open a second kobe plug axially spaced from the kobe plug to form a second fluid channel through the tubing string wall.

86. The method of claim 85 wherein the tool moves from the kobe plug to the second kobe plug while moving along the tubing string.

87. The method of claim 85 further comprising delaying a full opening of the channel until after the tool has opened both the kobe plug and the second kobe plug.

88. A method for forming a fluid channel through a tubing string wall, the method comprising; installing a tubing string in a wellbore, the tubing string including a tubular wall including an outer surface and an inner surface defining an open inner bore and a port through the wall; a kobe plug installed in the port with a cap portion accessible in the inner bore, a base mounted in the port and connected to the cap portion, a channel extending through the base and closed by the cap portion; and a shielding structure in the inner bore to shield the cap portion from protruding into the inner bore; introducing a port opening tool into the inner bore; manipulating the tool to overcome the shielding structure; removing the cap portion to open the channel and form the fluid channel though the tubing string wall; and capturing the cap portion such that the cap portion is prevented from becoming loose in the inner bore.

89. The method of claim 88 wherein capturing the cap portion includes collecting the cap portion in the tool.

90. The method of claim 88 wherein capturing includes storing the cap portion in the tubing string.

91. The method of claim 88 wherein capturing includes pushing the cap portion out through the channel away from the inner bore.

92. A tubing string system for installation in a wellbore comprising: a tubular body including a tubular wall with an outer surface and an inner surface defining an inner bore and a port through the tubular wall; a kobe plug installed in the port with a cap portion accessible in the inner bore, a base mounted in the port and connected to the cap portion, a channel extending through the base and closed by the cap portion; a shielding structure in the inner bore to shield the cap portion from protruding into the inner bore; and a port opening tool for overcoming the shielding structure and removing the cap portion from the base, wherein the shielding structure includes a shielding wall extending alongside the cap portion and the port opening tool includes a structure for reaching past the shielding wall to remove the cap portion.

93. The tubing string system of claim 92 wherein the shielding wall is a sidewall of a slot formed in the wall inner surface and the port opening tool includes a structure for reaching into the slot to remove the cap portion.

94. The tubing string system of claim 93 wherein the sidewall defines a slot depth and the slot depth is greater than the height of the cap portion such that the cap portion is fully recessed in the slot.

95. The tubing string system of claim 93 wherein the slot includes a return overlying a portion of the cap portion and the port opening tool includes a structure for reaching past the return and into the slot to remove the cap portion.

96. The tubing string system of claim 92 wherein the shielding wall includes an extension of the wall inner surface overlying a portion of the cap portion and the port opening tool includes a structure for reaching past the extension to remove the cap portion.

97. A tubing string system for installation in a wellbore comprising: a tubular body including a tubular wall with an outer surface and an inner surface defining an inner bore and a port through the tubular wall; a kobe plug installed in the port with a cap portion accessible in the inner bore, a base mounted in the port and connected to the cap portion, a channel extending through the base and closed by the cap portion; a shielding structure in the inner bore to shield the cap portion from protruding into the inner bore; and a port opening tool for overcoming the shielding structure and removing the cap portion from the base, wherein the port opening tool is a plug and the sleeve includes a seat for retaining the plug such that a pressure driven force is generated to move the sleeve.

98. A tubing string system for installation in a wellbore comprising: a tubular body including a tubular wall with an outer surface and an inner surface defining an inner bore and a port through the tubular wall; a kobe plug installed in the port with a cap portion accessible in the inner bore, a base mounted in the port and connected to the cap portion, a channel extending through the base and closed by the cap portion; a shielding structure in the inner bore to shield the cap portion from protruding into the inner bore; a port opening tool for overcoming the shielding structure and removing the cap portion from the base; and a flow limiting device in the channel for at least restricting flow through the channel and for providing a delay before the port becomes fully open to fluid flow.

99. The tubing string system of claim 98 wherein the flow limiting device is removed by erosion.

100. A tubing string system for installation in a wellbore comprising: a tubular body including a tubular wall with an outer surface and an inner surface defining an inner bore and a port through the tubular wall; a kobe plug installed in the port with a cap portion accessible in the inner bore, a base mounted in the port and connected to the cap portion, a channel extending through the base and closed by the cap portion; a shielding structure in the inner bore to shield the cap portion from protruding into the inner bore; a port opening tool for overcoming the shielding structure and removing the cap portion from the base; and a cap portion capturing mechanism to capture the cap portion from becoming loose in the inner bore after the cap portion is removed from the base.

101. The tubing string system of claim 100 wherein the cap portion capturing mechanism pushes the cap portion outwardly through the channel toward the outer surface.

102. The tubing string system of claim 100 wherein the cap portion capturing mechanism stores the cap portion in the sub.

103. The tubing string system of claim 100 wherein the cap portion capturing mechanism collects the cap portion in the port opening tool.

104. A tubing string system for installation in a wellbore comprising: a tubular body including a tubular wall with an outer surface and an inner surface defining an inner bore and a port through the tubular wall; a kobe plug installed in the port with a cap portion accessible in the inner bore, a base mounted in the port and connected to the cap portion, a channel extending through the base and closed by the cap portion; a shielding structure in the inner bore to shield the cap portion from protruding into the inner bore; and a port opening tool for overcoming the shielding structure and removing the cap portion from the base, wherein the kobe plug is one in a series of kobe plugs spaced axially along the tubing string, the series of kobe plugs being configured to be acted upon by the port opening tool in sequence in one operation.

105. The tubing string system of claim 104 wherein the series of kobe plugs includes a second kobe plug axially spaced along the tubing string from the kobe sub and a second shielding structure for the second kobe plug; and the port opening tool also is operable to overcome the second shielding structure to open the kobe plug.

* * * * *